US011160409B2

(12) United States Patent
Bowman

(10) Patent No.: US 11,160,409 B2
(45) Date of Patent: Nov. 2, 2021

(54) STORAGE CONTAINER WITH REMOTE MONITORING AND ACCESS CONTROL

(71) Applicant: Kevin Bowman, Torrance, CA (US)

(72) Inventor: Kevin Bowman, Torrance, CA (US)

( * ) Notice: Subject to any disclaimer, the term of this patent is extended or adjusted under 35 U.S.C. 154(b) by 0 days.

(21) Appl. No.: 16/702,678

(22) Filed: Dec. 4, 2019

(65) Prior Publication Data

US 2021/0059455 A1 Mar. 4, 2021

Related U.S. Application Data

(60) Provisional application No. 62/892,649, filed on Aug. 28, 2019.

(51) Int. Cl.

| | |
|---|---|
| ***A47G 29/14*** | (2006.01) |
| ***B65D 81/18*** | (2006.01) |
| ***A47G 29/20*** | (2006.01) |
| ***A47G 29/30*** | (2006.01) |

(52) U.S. Cl.

CPC ..... *A47G 29/141* (2013.01); *A47G 29/20* (2013.01); *A47G 29/30* (2013.01); *B65D 81/18* (2013.01); *A47G 2029/143* (2013.01); *A47G 2029/147* (2013.01)

(58) Field of Classification Search

CPC ..... A47G 29/141; A47G 29/30; A47G 29/20; A47G 2029/143; A47G 2029/147; B65D 81/18

See application file for complete search history.

(56) References Cited

U.S. PATENT DOCUMENTS

| | | | | |
|---|---|---|---|---|
| 10,444,042 | B1 * | 10/2019 | Radcliff | G01J 1/42 |
| 10,883,754 | B2 * | 1/2021 | Dade | F25D 13/04 |
| 2002/0169628 | A1 * | 11/2002 | Bauer | G06Q 30/0601 705/26.1 |
| 2002/0178074 | A1 * | 11/2002 | Bloom | G06Q 10/08 705/26.81 |
| 2004/0243426 | A1 * | 12/2004 | Hashimoto | A47G 29/141 232/20 |
| 2005/0083176 | A1 * | 4/2005 | Yamada | G06Q 10/08 340/5.73 |
| 2005/0104716 | A1 * | 5/2005 | Simms | G07C 9/00571 340/5.73 |
| 2007/0193834 | A1 * | 8/2007 | Pai | G06Q 10/08 186/3 |
| 2015/0199857 | A1 * | 7/2015 | Mackin | G07C 9/00896 340/5.26 |
| 2015/0371468 | A1 * | 12/2015 | Mackin | G07F 17/12 340/5.26 |
| 2016/0066733 | A1 * | 3/2016 | Gozar | G06Q 10/0833 232/18 |

(Continued)

*Primary Examiner* — Brian E Miller
(74) *Attorney, Agent, or Firm* — Daniel M. Cohn; Howard M. Cohn

(57) ABSTRACT

A remotely managed lockable storage container includes a lid, an electronically controlled lock, an internal temperature sensor; an electronic communication module comprising a processor, a communication interface, a camera system, an interior motion detector; a computer memory containing machine instructions, that when executed by the processor, cause the processor to transmit a container interior temperature reading and a lock status to a remote computing device via the communication interface.

14 Claims, 20 Drawing Sheets

(56) References Cited

U.S. PATENT DOCUMENTS

| | | | | |
|---|---|---|---|---|
| 2016/0140496 | A1* | 5/2016 | Simms | B64C 39/024 705/337 |
| 2016/0259914 | A1* | 9/2016 | Iantorno | G16H 20/13 |
| 2017/0061373 | A1* | 3/2017 | Hara | A47G 29/141 |
| 2017/0124547 | A1* | 5/2017 | Natarajan | G06Q 20/4097 |
| 2017/0140550 | A1* | 5/2017 | Zhang | G06T 7/50 |
| 2017/0215620 | A1* | 8/2017 | Dade | F25D 25/02 |
| 2018/0165782 | A1* | 6/2018 | Ibe | G06Q 10/08355 |
| 2018/0167394 | A1* | 6/2018 | High | H04L 63/123 |
| 2018/0177319 | A1* | 6/2018 | Willis | A47G 29/141 |
| 2018/0205682 | A1* | 7/2018 | O'Brien, V | G06Q 10/0833 |
| 2018/0232976 | A1* | 8/2018 | Schoenfelder | G07C 9/23 |
| 2019/0043298 | A1* | 2/2019 | Moudy | G07C 9/00857 |
| 2019/0056258 | A1* | 2/2019 | Gelada Camps | G01F 23/2928 |
| 2019/0122463 | A1* | 4/2019 | Romero | G05B 19/042 |
| 2019/0197195 | A1* | 6/2019 | Krishnamurthy | G06F 30/00 |
| 2019/0213389 | A1* | 7/2019 | Peruch | G06K 9/00201 |
| 2019/0277552 | A1* | 9/2019 | Vu | F25D 23/025 |
| 2019/0362577 | A1* | 11/2019 | Vigil | G06K 7/1417 |
| 2020/0134948 | A1* | 4/2020 | Sengstaken, Jr. | G07C 9/00571 |
| 2020/0250611 | A1* | 8/2020 | Pourteymour | G06Q 10/0833 |
| 2020/0281386 | A1* | 9/2020 | Knox | A47G 29/22 |
| 2020/0311671 | A1* | 10/2020 | Lundahl | G07C 9/00571 |
| 2020/0327687 | A1* | 10/2020 | Kadowaki | G06T 7/60 |
| 2020/0393854 | A1* | 12/2020 | Romanucci | G05B 19/4155 |

* cited by examiner

STORAGE CONTAINER WITH REMOTE MONITORING AND ACCESS CONTROL

CROSS-REFERENCE TO RELATED APPLICATIONS

This application claims the benefit of U.S. Provisional Patent Application No. 62/892,649 filed on Aug. 28, 2019 which is incorporated in its entirety herein by reference.

FIELD

The present invention relates generally to storage containers, and more particularly, to a storage container with remote monitoring and access control.

BACKGROUND

E-commerce started in earnest in the early 1990s when the Internet became generally available for commercial use. Since then, thousands of businesses that utilize ecommerce have started. Technologies such as Electronic Data Interchange (EDI) and Electronic Funds Transfer (EFT) enabled businesses and customers to perform electronic transactions. An increasing number of people became comfortable with the purchasing of available goods and services over the Internet using secure connections and electronic payment services.

E-commerce has numerous advantages over "brick and mortar" stores and mail order catalogs. Consumers can quickly and easily search through a large collection of products and services. Consumers can easily compare prices and buy the desired product at the best prices.

E-commerce vendors also get significant advantages. The web and its search engines provide a way to be found by customers without expensive advertising campaign. This allows even small online shops can reach global markets. This technology also allows the tracking of customer preferences and creation and presentation of individually-tailored marketing.

The rise in e-commerce transactions has increased the amount of goods delivered to our front doors and porches. Furthermore, initially, e-commerce was limited to non-perishable items such as books and clothing. Nowadays, with localized delivery options, the option to purchase perishable food items exists in many areas. It is therefore desirable to have delivery options conducive to the current trends in e-commerce.

SUMMARY

In one embodiment, there is provided a lockable storage container, comprising: a lid; an electronically controlled lock; an internal temperature sensor; an electronic communication module comprising: a processor; a communication interface; a camera system; an interior motion detector; a non-transitory computer memory containing machine instructions, that when executed by the processor, cause the processor to transmit a container interior temperature reading and a lock status to a remote computing device via the communication interface.

In another embodiment, there is provided a lockable storage container, comprising: a lid;

an electronically controlled lock; an internal temperature sensor; an electronic communication module comprising: a processor; a communication interface; a barcode scanner; a camera system; an interior motion detector; a lid object sensor; a non-transitory computer memory containing machine instructions, that when executed by the processor, cause the processor to transmit a lid-disposed object presence status, container interior temperature reading, and a lock status to a remote computing device via the communication interface.

In yet another embodiment, there is provided a lockable storage container, comprising: a lid; an electronically controlled lock; an interior temperature sensor; an exterior temperature sensor; an electronic communication module comprising: a processor; a communication interface; a barcode scanner; a camera system; an interior motion detector; a lid object sensor; a non-transitory computer memory containing machine instructions, that when executed by the processor, cause the processor to: compute an estimated interior temperature change rate, based on data from the interior temperature sensor and data from the exterior temperature sensor; compute an estimated temperature threshold time based on the estimated interior temperature change rate; and transmit the estimated temperature threshold time to a remote computing device via the communication interface.

BRIEF DESCRIPTION OF THE DRAWINGS

The structure, operation, and advantages of the present invention will become further apparent upon consideration of the following description taken in conjunction with the accompanying figures (FIGS.). The figures are intended to be illustrative, not limiting.

Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity. Furthermore, for clarity, some reference numbers may be omitted in certain drawings.

DETAILED DESCRIPTION

Millions of delivered packages from online orders are stolen from front porches, driveways, mailboxes, and front steps of homes every year. So-called "porch pirates" often peruse neighborhoods, looking for unattended packages left on porches and driveways. Additionally, with the proliferation of local delivery services for fresh groceries, there is the issue of safely storing such items until the resident can properly store such items in his/her refrigerator or freezer.

Disclosed embodiments provide a remotely managed container that includes climate monitoring and/or control, access monitoring and/or control, as well as inventory management functions that provide guidance to delivery personnel on how to optimally store and secure delivered parcels. Disclosed embodiments transcend a simple locking mechanism and offer a complete and secure unattended delivery solution that integrates peripherals that can include a motion detecting camera enabled with live view availability, as well as a scanner that has the ability to read shipping barcodes. In embodiments, the container is only unlocked in response to validation of an address and date on the package barcode, confirming a proper delivery. Embodiments include a locking mechanism with the ability to remotely unlock/lock and send notifications to the container user/owner. Embodiments further provide for one-time codes for temporary access for one-time users. Some embodiments may further include active climate control such as refrigeration, to preserve perishable items such as groceries.

Disclosed embodiments can include a remotely managed lockable storage container, comprising: a lid; an electronically controlled lock; an internal temperature sensor; an electronic communication module comprising: a processor; a communication interface; a camera system; an interior motion detector; a non-transitory computer memory containing machine instructions, that when executed by the processor, cause the processor to transmit a container interior temperature reading and a lock status to a remote computing device via the communication interface.

Figure 1:
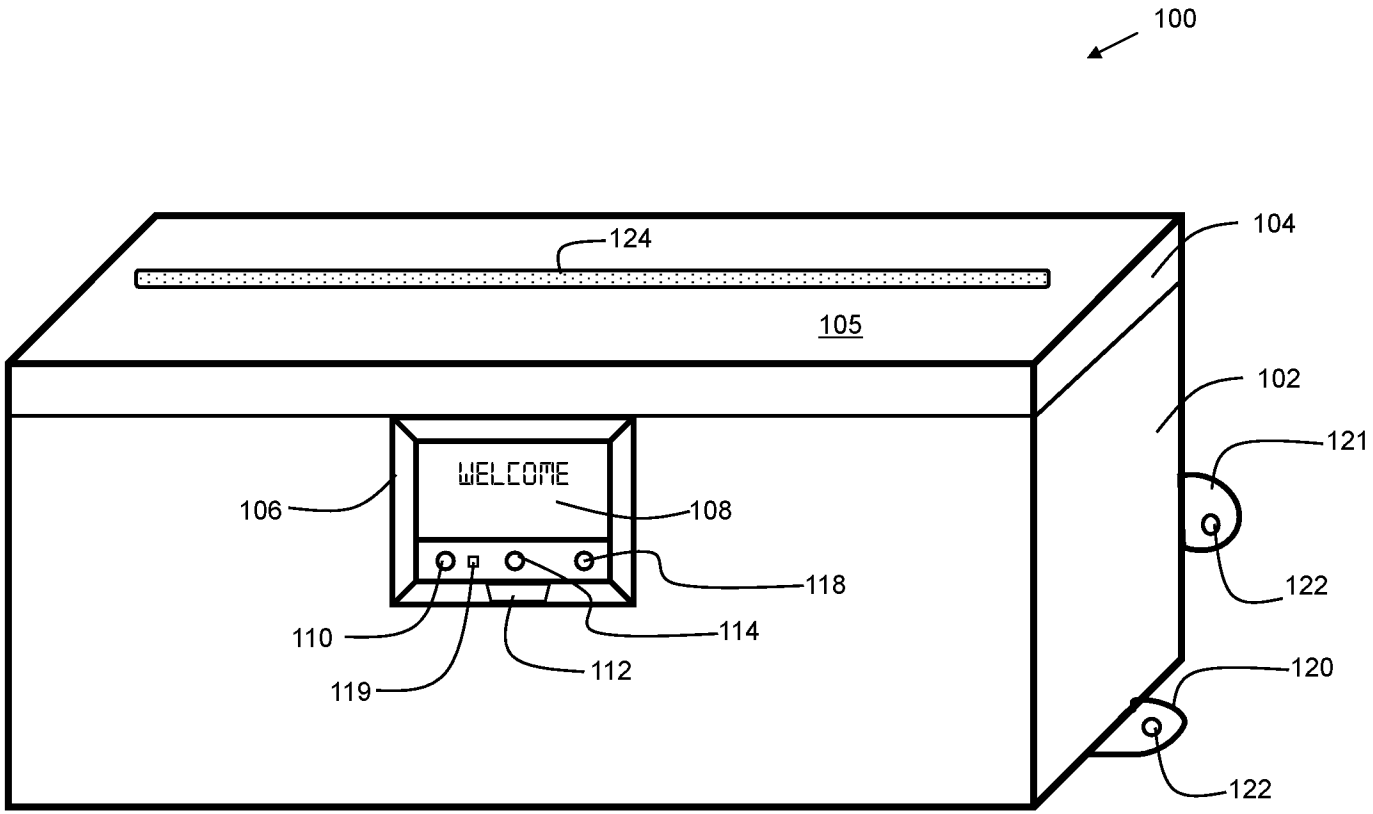
FIG. 1 shows a perspective view of a lockable storage container in accordance with embodiments of the present invention.

FIG. 1 shows a perspective view of a lockable storage container 100 in accordance with embodiments of the present invention. Container 100 comprises a bin portion 102, and a lid 104. An electronic communication module 106 is secured to the container 100 and provides a user interface 108 for interaction with the container 100. The user interface 108 may include a touchscreen and/or one or more buttons for interaction with the container. The electronic communication module 106 may further include a barcode scanner 112. The barcode scanner 112 may include a laser scanner, camera, or other suitable scanner suitable for scanning barcodes and/or two-dimensional "OR" codes. The electronic communication module 106 may further include a forward-facing camera 110. The forward-facing camera 110 can be used to monitor and/or stream video of a person approaching the container 100. The electronic communication module 106 can further include a microphone 114. The microphone 114 may be used for detection of ambient sounds, as well as enabling communication between a remote user, and a person in proximity to the container 100. The electronic communication module 106 may further include a light 118, such as a light-emitting diode (LED). In embodiments, the light 118 may be activated to indicate various conditions, including, but not limited to, unlocking of the container 100, locking of the container 100, and/or a person approaching the container 100. Some embodiments may further include a proximity sensor 119, such as a passive infrared (PIR) sensor for detecting motion/activity in proximity to the container 100.

Embodiments of the container 100 may include thermal insulation, such as a thermally insulated liner and/or thermally insulated walls. The insulation can include, but is not limited to fiberglass, polystyrene, and/or other suitable insulating materials. Some embodiments may include a refrigeration unit to provide active cooling. Embodiments may further include one or more anchor flanges, indicated as 120, that include a mounting hole 122 formed therein. As part of an installation process, the anchor flanges can be used to secure the container 100 to a floor surface such as a porch or deck. Some embodiments may further include one or more wall-mounting anchor flanges as well, indicated as 121, for securing the container 100 to a wall instead of, or in addition to, securing the container 100 to a floor surface.

Embodiments can include a lid object sensor 124. In embodiments, the lid object sensor 124 is disposed on the top surface 105 of lid 104. In embodiments, the lid object sensor 124 can include, but is not limited to, an optical sensor, a pressure sensor, and/or other suitable sensor type. The lid object sensor 124 is configured and disposed to cause a processor to transmit a lid-disposed object presence status, indicative of if one or more objects are present on the top surface 105 of lid 104. The lid object sensor 124 is used to manage placement of objects such as delivery packages on the top surface 105 of the lid 104. In some embodiments, the electronic communication module can instruct a person (e.g. a delivery person) to place an object inside the container 100, on the top surface 105 of the container 100, and/or remove an object currently inside the container and place it on the top surface 105 as part of making room for a different package/object to be stored in the interior of the container 100.

Figure 2B:
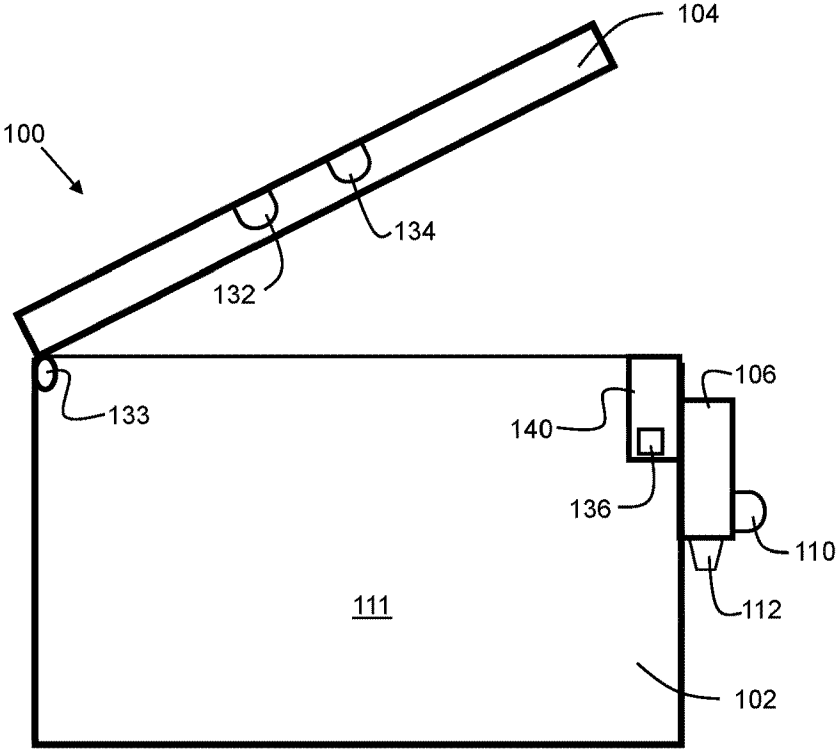
FIG. 2B shows a side view of a lockable storage container in accordance with embodiments of the present invention in an opened configuration.
Figure 2A:
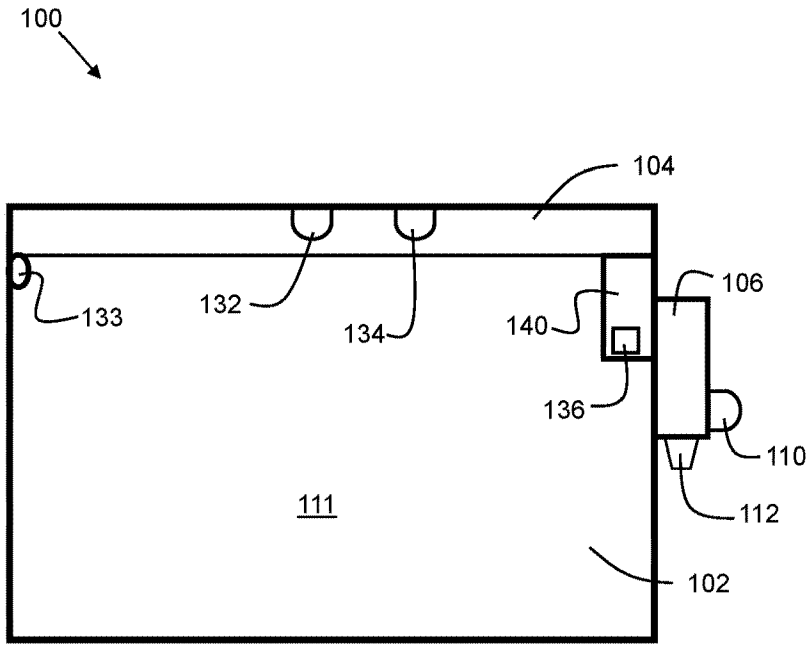
FIG. 2A shows a side view of a lockable storage container in accordance with embodiments of the present invention in a closed configuration.

FIG. 2A shows a side view of a lockable storage container 100 in accordance with embodiments of the present invention in a closed configuration. This view is a cutaway view, indicating components disposed within the interior 111 of the container 100. These components include an electronic lock 140. The electronic lock 140 is used to secure the lid 104 in a closed configuration as shown in FIG. 2A. In embodiments, the electronic lock 140 may be locked/unlocked via activation of a solenoid, a magnetic lock, or other suitable lock type.

Container 100 may further include an interior motion detector (sensor) 136. The interior motion sensor 136 may be used as an additional safety feature in some embodiments. In these embodiments, if motion is detected within the interior 111 by interior motion sensor 136, the lock 140 is automatically released (unlocked), and an alert may be issued by activating an audible tone or noise from the electronic communication module 106, and/or sending an alert to a remote computing device such as a smartphone or tablet computer associated with a user of the container 100. In this way, inadvertent or intentional locking a person or animal inside the container 100 is prevented.

Container 100 may further include at least one interior camera, indicated as 132.

Container 100 may further include a depth sensor 134. In embodiments, the depth sensor 134 may be an infrared sensor, laser sensor, or other suitable depth sensor type. The interior camera 132 and depth sensor 134 are used in some embodiments to evaluate the available space within the interior 111 of the container 100. In embodiments, the camera 132 and/or depth sensor 134 may be configured and disposed to project points of infrared light onto the interior of the container, creating a cloud of points, which the sensor 134 reads for the time of flight determination, thereby gathering depth information.

In embodiments, the camera system includes a forward-facing camera, and at least one interior camera. In embodiments, the at least one interior camera includes a depth sensor. FIG. 2B shows a side view of a lockable storage container in accordance with embodiments of the present invention in an opened configuration. In embodiments, the lid 104 may be affixed to the bin portion 102 via a hinge 133.

Figure 3:
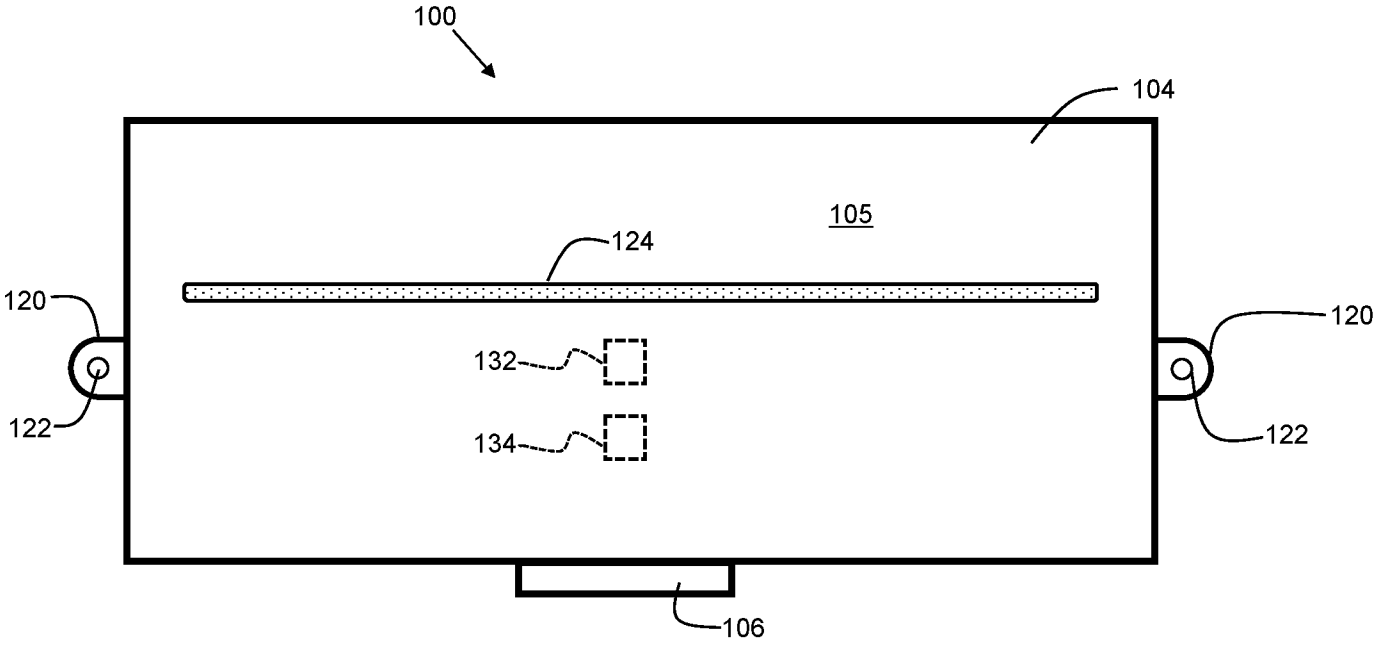
FIG. 3 shows a top-down view of a lockable storage container in accordance with embodiments of the present invention in a closed configuration.

FIG. 3 shows a top-down view of lockable storage container 100 in accordance with embodiments of the present invention in a closed configuration. In this view, the lid object sensor 124 is shown on the top surface 105 of lid 104. In embodiments, the lid object sensor 124 is implemented as a strip-shaped sensor. The lid object sensor 124 may include a pressure sensor that activates when the weight of an object such as a package is placed thereon. Alternatively, the lid object sensor 124 may include an optical sensor. While one strip sensor is shown in FIG. 3, in practice, there can be multiple strips arranged in a grid or other suitable pattern to detect objects at various locations on the top surface 105 of lid 104. In some embodiments, the lid object sensor may include one or more cameras disposed on the container 100 and oriented in a configuration such that the top surface 105 of lid 104 is monitored to detect placement and/or removal of objects from the top surface 105 of lid 104.

Additionally, in this view, there are shown two anchor flanges, indicated as 120, that include a mounting hole 122 formed therein. The anchor flanges 120 can be used for securing the container 100 to a floor, such as a deck or porch. In some embodiments, the container 100 may include anchor flanges oriented for securing the container 100 to a wall (e.g. 121 of FIG. 1).

Additionally, in this view, the location of the interior camera, indicated as 132 and depth sensor 134, are shown. In embodiments, the interior camera 132 and depth sensor 134 are affixed to the underside of lid 104. The camera 132 and depth sensor 134 may be connected to electronic communication module 106 via a ribbon cable (not shown) that supplies power and data connections from the 105 to the camera 132 and depth sensor 134.

Figure 4:
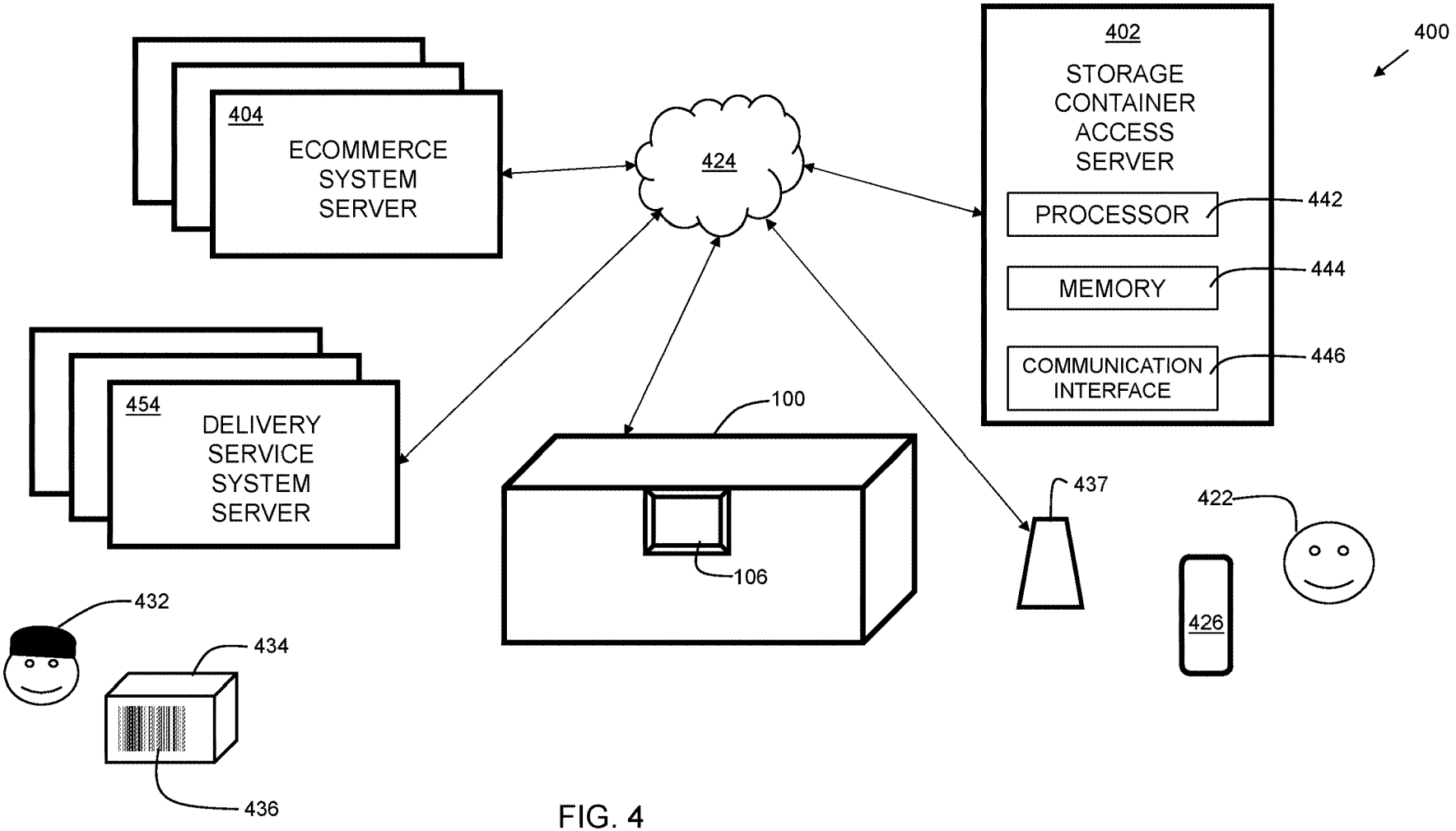
FIG. 4 shows a system diagram in accordance with embodiments of the present invention.

FIG. 4 shows a system diagram 400 in accordance with embodiments of the present invention. The container 100 interfaces with network 424 via a communication interface. In embodiments, the communication interface can include a wireless communication protocol such as Wi-Fi, cellular (5G), Bluetooth, and/or other suitable communication technique. Network 424 can include the Internet, a local area network, and/or wide area network. Storage container access server 402 is also connected to network 424, such that the electronic communication module 106 of the container 100 communicates with the storage container access server 402 via network 424. The storage container access server includes a processor 442, a memory 444, and a communication interface 446. The memory 444 may include non-transitory computer-readable storage including, but not limited to, RAM, ROM, flash, optical storage, magnetic storage, solid state storage, and/or other suitable storage technology. In embodiments, the storage container access server 402 may be implemented in virtual machines (VMs), and/or utilization of containers (e.g. Docker, LXC, etc.).

In embodiments, the storage container access server 402 provides functions such as account creation, account management, remote control and configuration of the container 100, and/or communication between remote computing devices and the electronic communication module 106 of the container 100. In embodiments, the electronic communication module 106 of the container 100 is also in communication with one or more ecommerce system servers 404. As an example, online sellers/retailers such as Amazon®, eBay®, Target®, and the like, may expose application programming interface (API) functions to enable the electronic communication module 106 of the container 100 to retrieve metadata regarding expected deliveries. The metadata can include, but is not limited to, size, weight, approximate value, expected arrival time, and/or perishable status.

In embodiments, the electronic communication module 106 of the container 100 is also in communication with one or more delivery service system servers 454. As an example, delivery services such as the United States Postal Service (USPS), UPS®, FedEx®, DHL® and/or other delivery services, may expose application programming interface (API) functions to enable the electronic communication module 106 of the container 100 to retrieve metadata regarding expected deliveries. The metadata can include, but is not limited to, size, weight, approximate value, expected arrival time, and/or perishable status of package contents.

In practice, a delivery person 432 may arrive at a delivery location/address with a package 434. Package 434 contains a barcode 436 affixed or printed thereon. The delivery person 432 may first perform an authorization by scanning an access code (e.g. on a computing device such as a handheld computer) with the scanner (see 112 of FIG. 1) of the container 100. The authorization code may be sent to the storage container access server 402 for authentication. If authentication is successful, the storage container access server sends an unlock command to the container 100. The container 100 is then opened. Optionally, the delivery person 432 may scan the package barcode 436 via the scanner (see 112 of FIG. 1) of the container 100 to confirm which package is being delivered. The delivery person 432 then closes the lid to the container 100, causing it to lock.

In some embodiments, the barcode 436 of package 434 is scanned by the scanner (see 112 of FIG. 1) of the container 100 prior to the unlocking of the container 100. In some embodiments, the barcode 436 of the package 434 serves as the authorization to allow the container 100 to become unlocked.

In embodiments, various events associated with the delivery of the package 434 may be conveyed to a remote computing device 426 associated with an end-user 422. In embodiments, the remote computing device 426 may include a smartphone, tablet computer, smartwatch, and/or other wearable computer or suitable computing device. As an example, the remote computing device 426 may receive a text message, email, and/or audible alert indicating arrival and/or approaching of the delivery person, opening/unlocking of the container, placement of the package 434 within the container, and/or locking of the container. In some embodiments, two-way communication between the end-user 422 and the delivery person 432 may be facilitated via peripheral devices on the electronic communication module 106 such as a camera, microphone, and speaker, allowing the end-user to provide verbal instructions to the delivery person 432 regarding placement of the package 434.

Embodiments may be configured and disposed to interface with a smart speaker 437, such as the Amazon Echo, Google Home, or the like. In such embodiments, exposed APIs may be used to create "skills" or functions that may be activated by voice from user 422. In embodiments, the user may utter a phrase to control or obtain status of the container. As an example, the user may utter: "Alexa, is my container locked?" The smart speaker 437 may then communicate with the container 100 to determine the lock status, and audibly convey that to the user 422 via a "Yes" or "No" response. In some embodiments, the smart speaker 437 may communicate directly with the container 100 via an ad hoc wireless network, wired network, or other suitable localized communication. In other embodiments, the smart speaker 437 may communicate via network 424 to access the storage container access server 402 to retrieve a status for the container 100, or issue a control command (e.g. unlock) for the container 100.

Figure 5:
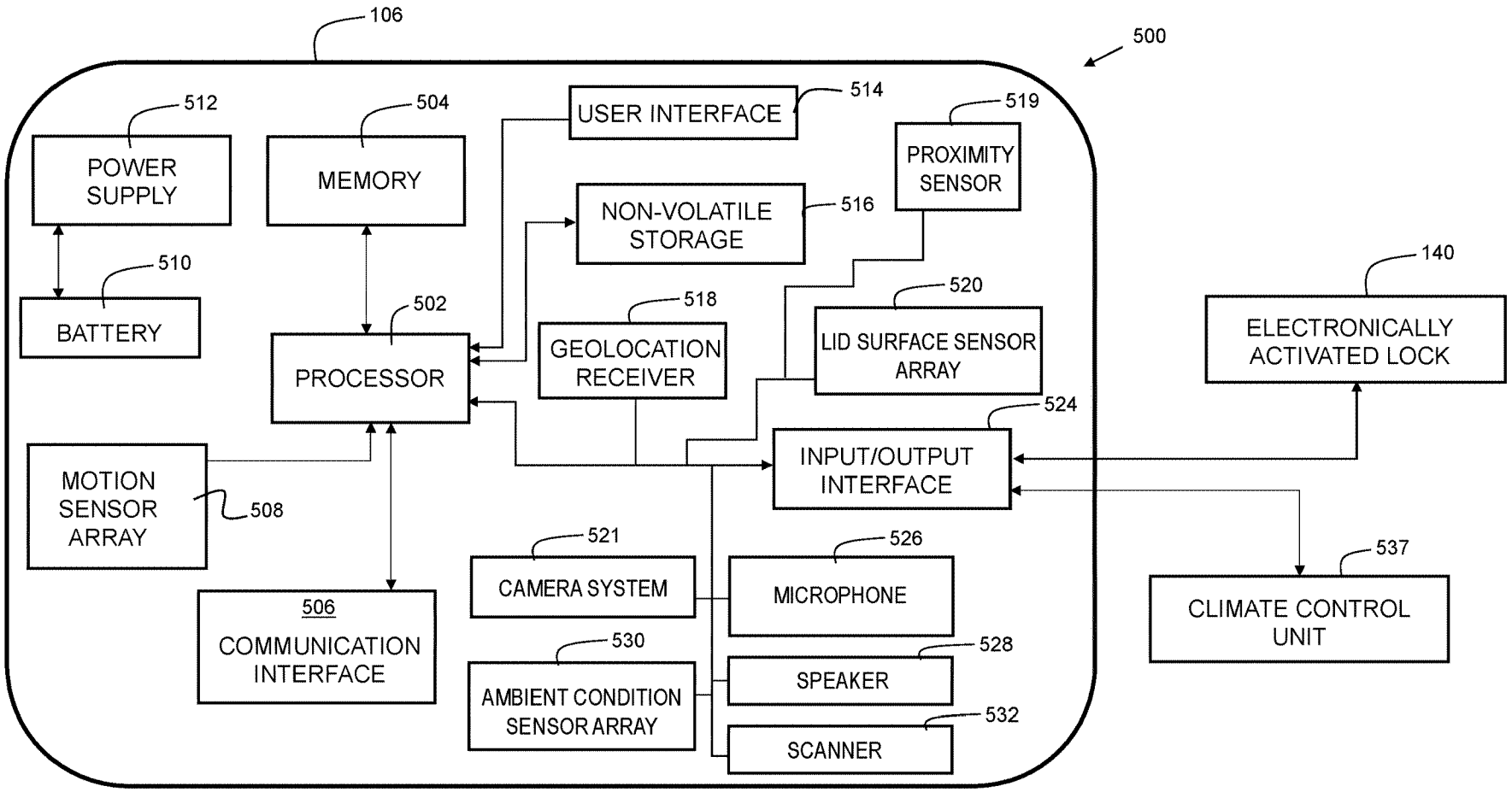
FIG. 5 shows a block diagram of an electronic communication module for a lockable storage container of disclosed embodiments.

FIG. 5 shows a block diagram 500 of an electronic communication module 106 for a lockable storage container of disclosed embodiments. Some of the components shown in FIG. 5 may not be present in every embodiment. The electronic communication module 106 includes a processor 502, which is coupled to memory 504. The memory 504 may include non-transitory computer-readable storage including, but not limited to, RAM, ROM, flash, optical storage, magnetic storage, solid state storage, and/or other suitable storage technology. The electronic communication module 106 may further include a communication interface 506. The communication interface 506 may include Wi-Fi, cellular transceivers, Bluetooth, Bluetooth Low Energy (BLE), Zigbee, Thread, and/or other suitable communication technology. The communication interface 506 may be used to communicate with remote computing devices such as handheld computers, smartphones, and the like.

Disclosed embodiments may further include a motion sensor array 508. The motion sensor array may include multiple exterior and interior motion sensors. The exterior motion sensor(s) may be configured and disposed to assert a signal based on motion activity at or near the container 100. This can serve to provide notifications to an end-user when there is motion detected near the container, such as from a person approaching the container. The interior motion sensor(s) may be configured and disposed to assert a signal based on motion activity within the interior 111 of the container 100. This can be used to implement a safety feature for prevention of locking a person or animal in the container 100. In embodiments, upon detecting interior motion, the container 100 may be unlocked. Additionally, a notification may be sent to a remote computing device (e.g. 426, associated with an end user 422) indicating the event. Additionally, video acquired from interior camera 132 may be transmitted to the remote computing device, and/or storage container access server 402. In embodiments, the motion sensor array 508 includes multiple passive infrared (PIR) sensors.

Disclosed embodiments may further include a power supply 512. In embodiments, the power supply 512 may be configured to connect to a standard household electrical outlet (120V). Embodiments may further include a battery 510. In embodiments, the battery 510 serves to implement an uninterruptable power supply (UPS) function, such that when there is a disruption in supplied power, the container may continue to communicate for a period of time until power is restored. Additionally, events such as a power loss event, and/or power restoration event may be logged and transmitted to the remote computing device, and/or storage container access server 402.

Disclosed embodiments may further include an input/output (I/O) interface 524. The I/O interface 524 may include multiple pins configured as inputs, outputs, or bidirectional pins for interfacing with various peripherals, including, but not limited to, an electronically activated lock 140 that is used to lock/unlock the lid 104 of the container 100.

Some embodiments may further include a climate control unit 537 to provide active temperature control. Other embodiments may include thermal insulation, but no refrigeration unit. In embodiments, the climate control unit 537 may include refrigeration, and/or heating elements.

Disclosed embodiments may further include a geolocation receiver 518. The geolocation receiver 518 may include a Global Positioning System (GPS) receiver, and/or other suitable receiver such as compatible with the GLONASS and/or Galileo geolocation systems. The geolocation receiver 518 may be utilized for various features for provisioning and/or theft prevention and detection. As an example, the geolocation receiver 518 may derive latitude and longitude values for the current location of the container 100, which can be transmitted to the storage container access server 402 via network 424. The storage container access server 402 may then utilize a street address lookup function to automatically associate the container with a street address, streamlining the account creation process. Additionally, in response to detecting a change in latitude and longitude values for the current location of the container 100, a notification may be sent to a remote computing device (e.g. 424, associated with an end user 422) and/or the storage container access server 402, indicating the event, to alert the end-user of possible theft of the container 100. In such embodiments, the geolocation receiver 518, processor 502, and communication interface 506, along with other necessary components, receive power from internal battery 510, so that the indication can be transmitted as the container 100 is removed. In embodiments, periodic location transmissions may be transmitted to the remote computing device (e.g. 426, associated with an end user 422) and/or the storage container access server 402, enabling law enforcement to be notified of the current location and/or direction of travel of a stolen container.

Disclosed embodiments may further include non-volatile storage 516. Non-volatile storage 516 may include one or more sections of protected flash memory, or other suitable memory for storing information such as a device serial number, model number, MAC address, and/or other suitable unique identifiers for a particular container 100. These unique identifiers can be used as part of the provisioning process when a user gets a new container 100.

Disclosed embodiments may further include a user interface 514. The user interface may include a touchscreen, a keyboard, and/or other buttons, switches, lights (LEDs), buzzers, speakers, and/or other peripherals for interfacing with a user, such as a delivery person. In some embodiments, the processor 502 utilizes communication interface 506 to communicate with a nearby mobile computing device such as a smartphone, tablet computer, and/or other suitable computing device. In these embodiments, elements of the user interface may be implemented on the mobile computing device. In some embodiments, the user interface may be implemented via HTML pages, an application (app) executing on the mobile computing device, and/or other suitable technique.

Disclosed embodiments may further include a lid surface sensor array 520. The lid surface sensor array 520 may include one or more pressure sensors, optical sensors, and/or other suitable sensors for detecting placement, position, and/or removal of objects from the top surface 105 of the lid 104 of the container 100. This enables disclosed embodiments to go beyond management of objects placed within the interior 111 of the container 100, and also manage objects (e.g. packages) placed on the top surface 105 of the lid 104 of the container 100.

Disclosed embodiments may further include a camera system 521. Camera system 521 may include multiple cameras, including visible light cameras and/or infrared cameras. The multiple cameras can include cameras disposed to acquire a view exterior to the container 100 (such as from camera 110), and/or cameras disposed to acquire a view of the interior of the container 100 (such as from camera 132).

Disclosed embodiments may further include an ambient condition sensor array 530. Ambient condition sensor array 530 may include multiple sensors, including temperature sensors for the interior of the container, exterior of the container, humidity sensors for the interior of the container, and exterior of the container, vibration sensors, moisture sensors, smoke detectors, and/or other sensor types. In embodiments, the electronic communication module 106 receives data from the ambient condition sensor array 530 and transmits it to the remote computing device 426 and/or storage container access server 402. This enables disclosed embodiments to provide information updates and/or alerts about the ambient conditions. In embodiments, the alerts can include temperature alerts, humidity alerts, smoke detection alerts, and/or other types of alerts. This can be very useful when the container 100 is used to store perishable items such as fresh food items. In those cases, when the temperature rises above a certain level, the perishable items risk being compromised. In such instances, the end user can be alerted to take action to retrieve the perishable items. In some embodiments, the end user can establish a one-time-use code to unlock the container, and provide that code to a neighbor or friend that is in the area and can quickly go to the container, unlock the container with the one-time-use code, and retrieve the perishable items and store them in his/her refrigerator until the end user can retrieve them. In this way, disclosed embodiments go far beyond a simple storage container, and serve to improve the technical field of unattended secure delivery.

Disclosed embodiments may further include a scanner 532. Scanner 532 may include a camera, laser scanner, magnetic stripe reader, and/or other suitable scanning device. In embodiments, the scanner 532 (similar to scanner 112 of FIG. 1) is disposed to scan barcodes, QR codes, alphanumeric codes, and/or other suitable identifiers. This allows inventory management of the contents stored in and/or on the container 100. In some embodiments, a delivery person can scan objects (e.g. delivered packages) prior to inserting them in, or placing them on, the container 100. In some embodiments, an end-user may also scan objects (e.g. delivered packages) upon removing the objects from the interior and/or top of container 100. This can be useful in certain embodiments such as multiuser embodiments. Such a use case may occur in the case of a shared dwelling such as a duplex home. In a duplex scenario, two households may share a single container. Users from each household scan removed objects. If a user inadvertently removes and scans an object belonging to the other household, an alert can be generated for users of both households to indicate the event to all parties.

Disclosed embodiments may further include a proximity sensor 519. Proximity sensor 519 may include one or more passive infrared (PIR) sensors configured and disposed to assert a signal based on motion detected near the container 100. This can include persons or animals approaching the container.

Disclosed embodiments may further include a microphone 526 for acquiring sound in and/or near the container 100. In embodiments, when a loud sound is detected, which could potentially indicate someone trying to break into the container, an alert message may be transmitted to the remote computing device 426, and/or storage container access server 402.

Disclosed embodiments may further include a speaker 528 for generating sound in and/or near the container 100. In embodiments, sounds generated by speaker 528 can include chirps, tones, and/or other sound effects to indicate a condition such as locking/unlocking of the container. Additionally, the sounds can include voice instructions from the container 100 using text-to-speech and/or prerecorded sound files. Additionally, the speaker 528, in combination with microphone 526 and camera system 521 enable two-way communication between a remote computing device 426 and the electronic communication module 106 of container 100.

The aforementioned components are not intended to be limiting. In embodiments, data from alternative/additional peripherals may be transmitted to/from the remote computing device 426, and/or storage container access server 402. Furthermore, for the sake of clarity, not all connections between components on block diagram 500 are shown. It will be understood that a variety of parallel and/or serial communications busses, wiring harnesses, ribbon cables, and/or other suitable connectivity may be included as necessary to properly connect each peripheral with any needed power, data, clock, and/or other logical signal connections.

Figure 6:
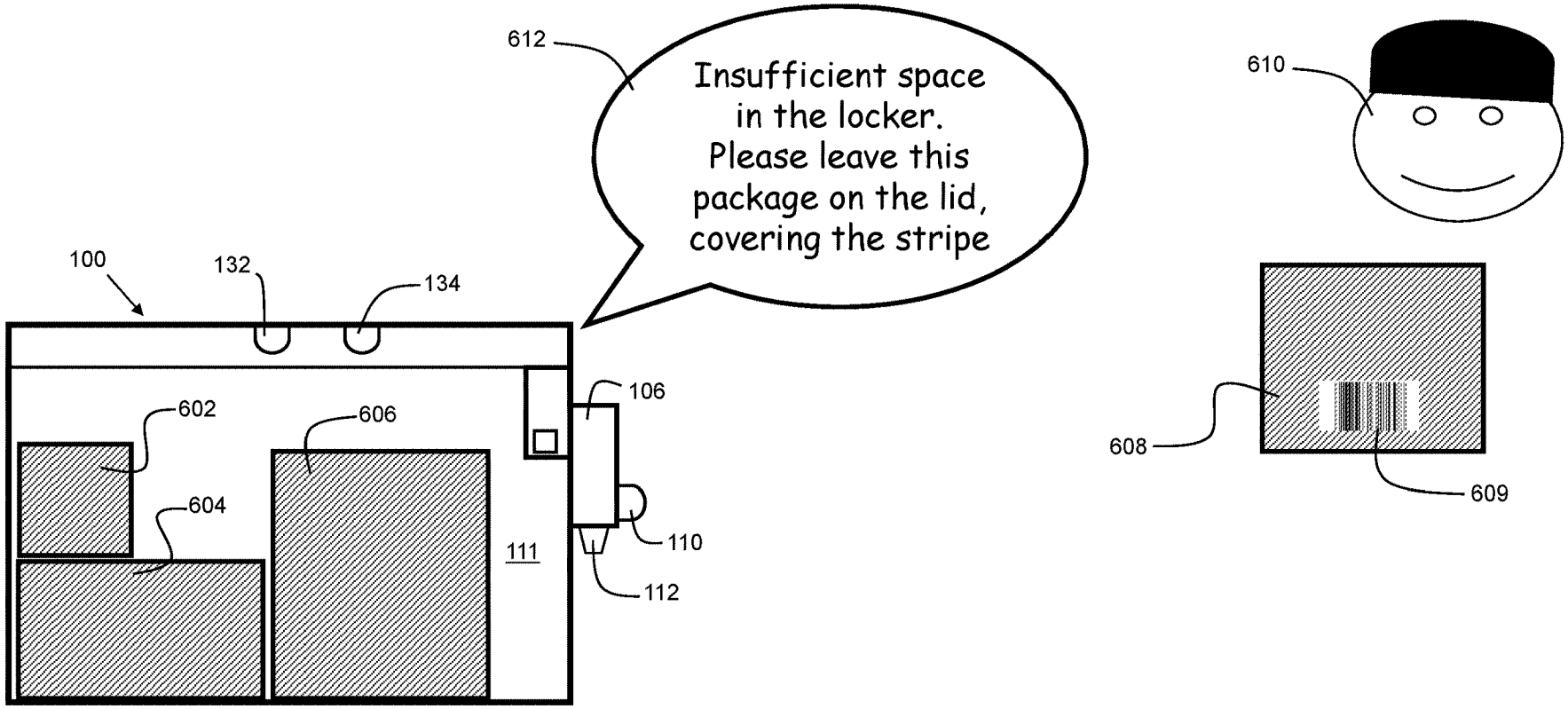
FIG. 6 shows an example of issuing an instruction for lid placement in accordance with embodiments of the present invention.

FIG. 6 shows an example of issuing an instruction for lid placement in accordance with embodiments of the present invention. In the example of FIG. 6, the container 100 already contains three objects in the interior 111. The objects 602, 604, and 606 may be previously delivered packages. Another delivery person 610 arrives with an additional object (package) 608 to be delivered. The interior camera 132 and depth sensor 134 can be used to perform an available volume assessment to assess the available volume in the interior 111 of container 100. In some embodiments, upon the delivery person 610 scanning a barcode 609 of the object 608 with the scanner 112, the electronic communication module 106 may retrieve metadata pertaining to package 608 from an ecommerce system server 404 and/or a delivery service system server 454. This metadata can include, but is not limited to, size, weight, approximate value, and/or perishable status. In response to determining that the size of the object 608 is greater than the available volume within the interior 111 of container 100, the electronic communication module 106 may output an instruction 612 for the delivery person 610. In embodiments, the available contiguous volume may be derived from the occupied volume by subtracting occupied volume from the total interior volume. In the example shown in FIG. 6, the total interior volume is the volume of the container 100 when empty (containing no objects), and is generally a constant value. The occupied volume is the volume occupied by objects 602, 604, and 606. This may be estimated by interior camera 132 and depth sensor 134.

In embodiments, the instruction 612 may be delivered/rendered as an audio instruction, and/or text-based instruction to a mobile device associated with the delivery person 610, and/or displayed on the user interface (514 of FIG. 5) of the electronic communication module 106. In embodiments, the memory further includes instructions, that when executed by the processor, cause the processor to compute an occupied volume estimate based on information from the interior camera, and compute a remaining available volume of the container, based on the occupied volume estimate. In embodiments, the memory further includes instructions, that when executed by the processor, cause the processor to issue an instruction for lid placement based on the occupied volume estimate, in response to receiving a delivery indication.

Figure 7:
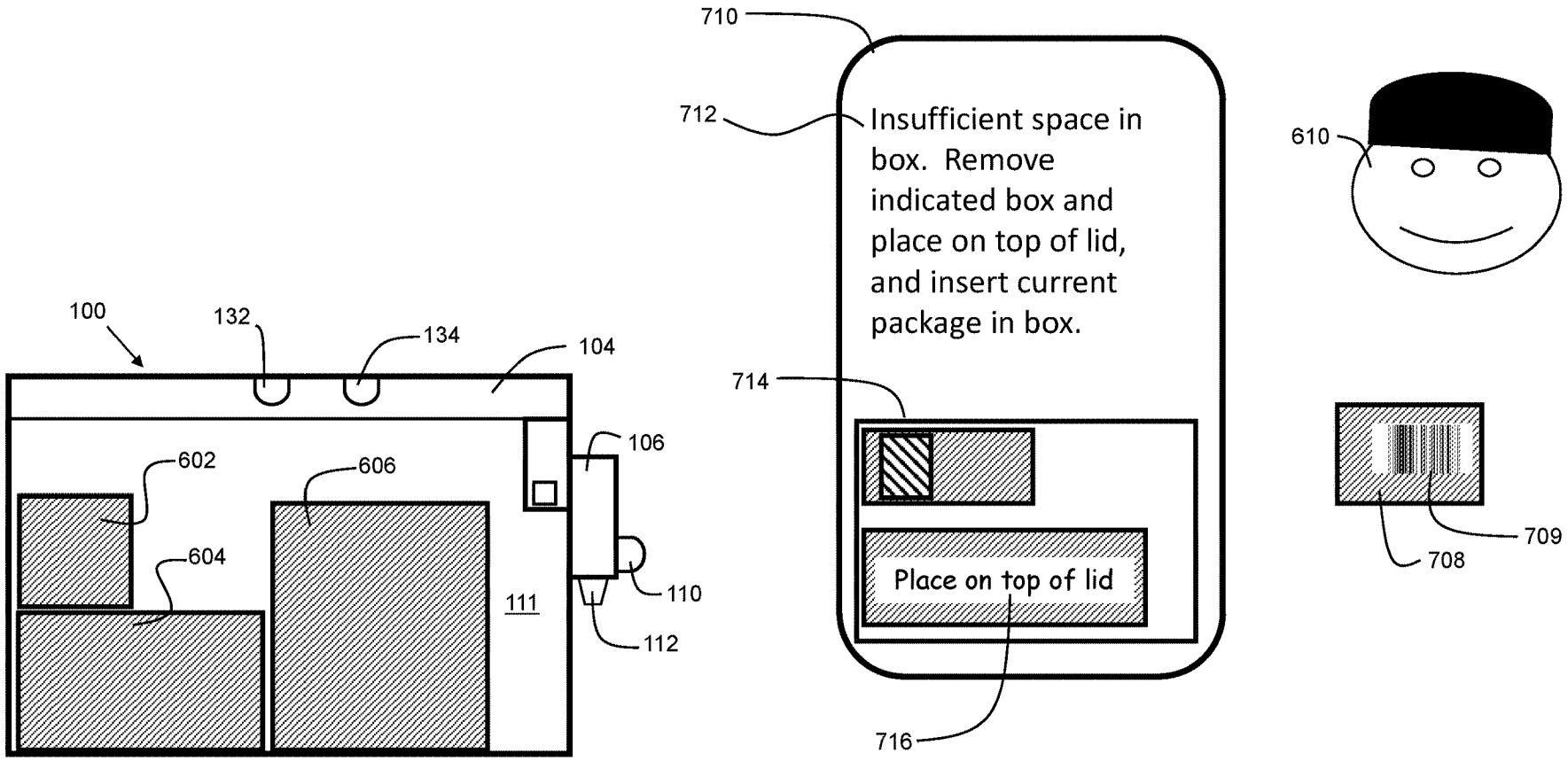
FIG. 7 shows an example of issuing a swap instruction in accordance with embodiments of the present invention.

FIG. 7 shows an example of issuing a swap instruction in accordance with embodiments of the present invention. In the example of FIG. 7, the container 100 already contains three objects in the interior 111. The objects 602, 604, and 606 may be previously delivered packages. Another delivery person 610 arrives with an additional object (package) 708 to be delivered. In some embodiments, upon the delivery person 610 scanning a barcode 709 of the object 708 with the scanner 112, the electronic communication module 106 may retrieve metadata pertaining to package 708 from an ecommerce system server 404 or a delivery service system server 454. This metadata can include, but is not limited to, size, weight, approximate value, and/or perishable status. In response to determining that there is currently insufficient available contiguous volume in the interior 111, disclosed embodiments may evaluate, based on acquired metadata, an optimal course of action to provide as much security/protection as possible for the delivered objects. As an example, if metadata indicates that the contents of object 708 are perishable (e.g. fresh dairy products), and that the contents of previously delivered object 606 are non-perishable low value objects, (e.g. a case of paper towels), then the electronic communication module 106 may generate instructions on a mobile device associated with the delivery person 610, and/or on a screen that is part of user interface 514 (FIG. 5). In embodiments, the instructions may include a text-based message 712 presented on an electronic screen 710 of a mobile electronic device associated with the delivery person 610. In addition, the instruction may include a digital image 714, which may be acquired from interior camera 132. In some embodiments, an augmented reality (AR) overlay 716 may be generated over a digital image of a specific object, and used to indicate the specific object that is currently within the interior 111 of the container 100 that is to be placed on the lid 104 of the container 100. In this way, disclosed embodiments improve the technical field of unattended secure delivery by managing objects stored in the interior, and providing "swap" instructions when appropriate, instructing delivery personal to remove interior objects and place them on the lid under certain conditions. In this way, perishable items such as fresh food, and/or high value items such as electronics, are given priority over non-perishable and/or low value items. In this way, unattended secure delivery is improved, enabling the convenience and time-savings of receiving most any type of item, including fresh food and valuable items, when a user is not available to receive the items immediately.

In embodiments, the memory further includes instructions, that when executed by the processor, cause the processor to: receive package metadata for a first package based on input from the barcode scanner; confirm interior storage for the first package based on input from the camera system; receive package metadata for a second package based on input from the barcode scanner; determine an insufficient volume condition based on the package metadata for the first package and the occupied volume estimate; identify a swap candidate based on the package metadata from the first package; and issue a swap instruction to indicate: removing the first package from interior storage; placing the second package in interior storage; and placing the first package on the lid.

Figure 8:
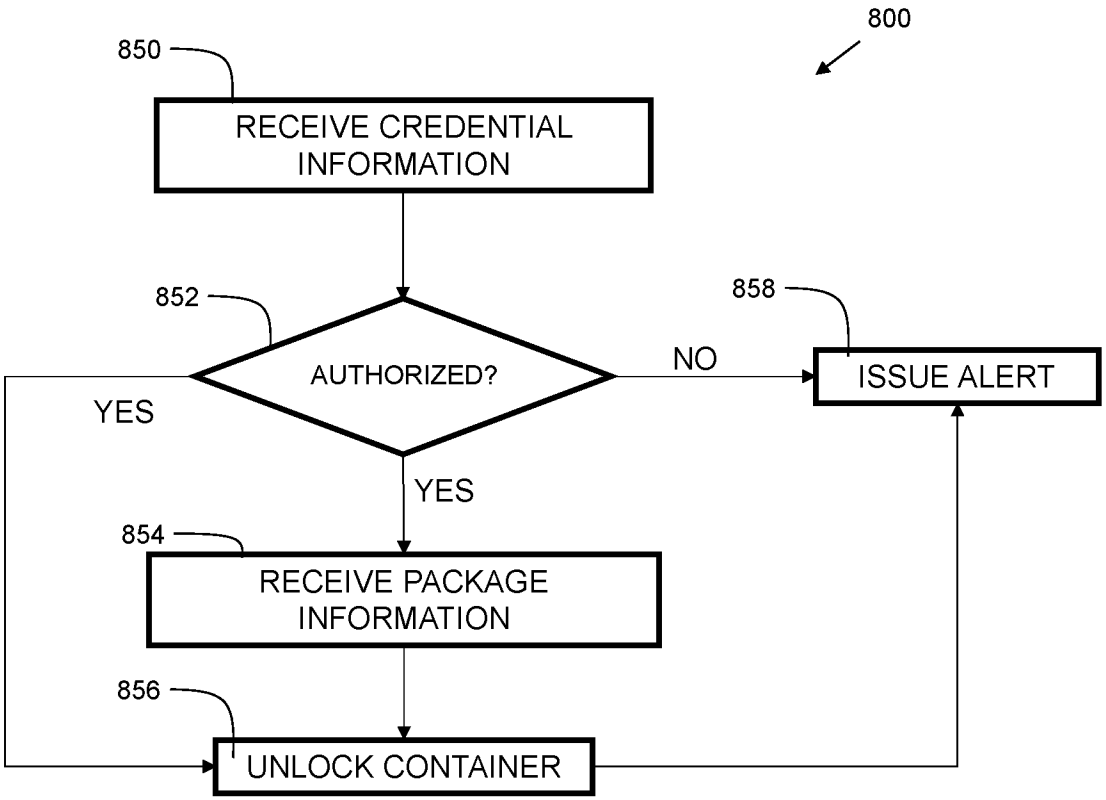
FIG. 8 is a flowchart indicating process steps for unlocking the container to place a package therein.

FIG. 8 is a flowchart 800 indicating process steps for unlocking the container to place an object/package therein. At process step 850, credential information is received. This can include a barcode, an alphanumeric code, a passphrase, and/or data transmitted from a radio-enabled fob, mobile computing device, wearable computer, or other suitable device. If, at 852, the credential is authorized, then the package information is optionally received at 854. In embodiments, this can include scanning a barcode affixed to the object/package with the scanner (112 of FIG. 1) of the container. In some embodiments, no scanning is required. In each case, after 852 and/or after 854, the process continues to 856 where the container is unlocked. If, at 852, the credential is not authorized, the container is not unlocked. The process terminates at 858 with issuing an alert. The alert can include one of a successful delivery, unauthorized access attempt, or other delivery-related event.

Figure 9:
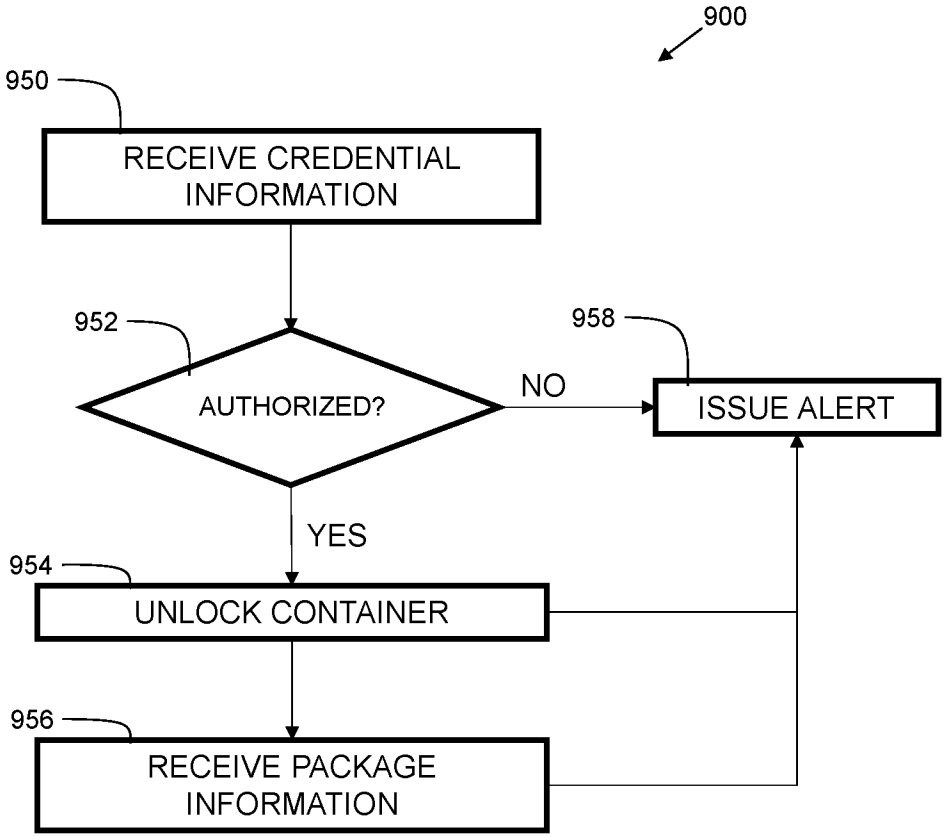
FIG. 9 is a flowchart indicating process steps for unlocking the container to remove a package therefrom.

FIG. 9 is a flowchart 900 indicating process steps for unlocking the container to remove an object/package therefrom. At 950, credential information is received. This can include a barcode, an alphanumeric code, a passphrase, and/or data transmitted from a radio-enabled fob, mobile computing device, wearable computer, or other suitable device. If, at 952, the credential is authorized, then the container is unlocked at 954 by operating the electronically activated lock 140 to be in an unlocked configuration. Optionally, at 956, package information is received. This can include scanning a barcode affixed to the object/package with the scanner (112 of FIG. 1) of the container. After one or more of the steps shown in FIG. 9, an alert is issued at 958. The alert can include one of an authorized access, unauthorized access attempt, or other delivery-related event. The alert may be transmitted to the remote computing device 426, and/or storage container access server 402.

Figure 10:
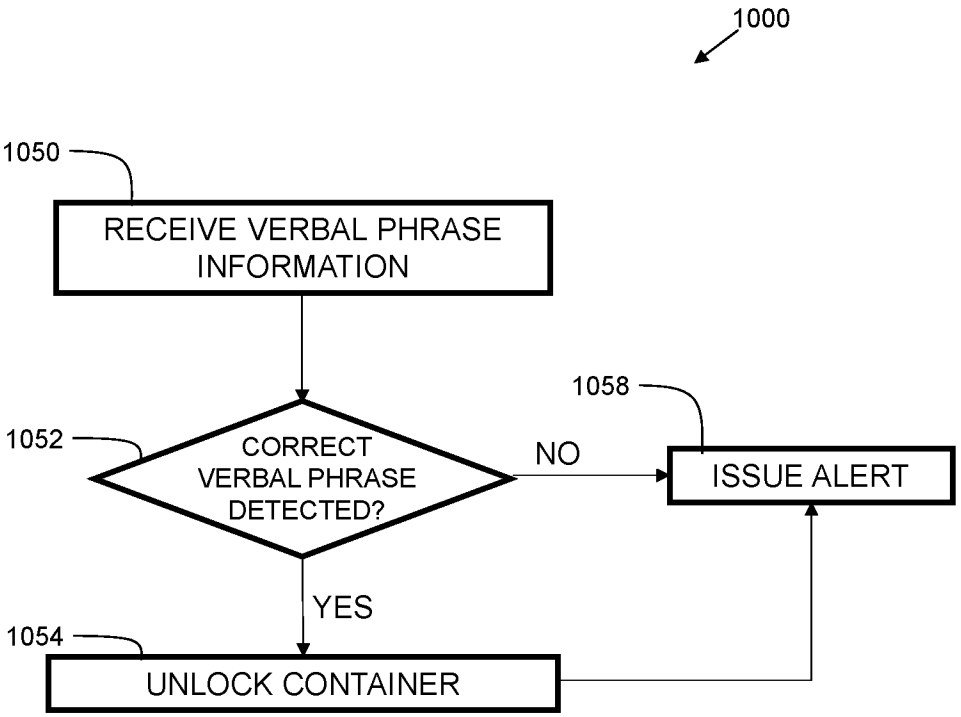
FIG. 10 is a flowchart indicating process steps for utilizing a verbal phrase to unlock the container.

FIG. 10 is a flowchart 1000 indicating process steps for utilizing a verbal phrase to unlock the container. In some embodiments, a verbal phase can be used to unlock the container 100. These embodiments are well-suited for a situation where the end user wants to grant access to a third party, where the third party may not have access to a mobile device or other suitable device/application for unlocking the container. In these embodiments, the user may establish a verbal phrase that is stored within the electronic communication module 106 and/or storage container access server 402. This may be accomplished through an account settings option via the user's mobile device, webpage via a personal computer, or other suitable technique. This phrase can be verbally or electronically provided to a third party. The third party can then utter the phrase in proximity of the container 100, where it is received by microphone 114 at 1050. The received utterance may be transmitted to the storage container access server 402 where it is converted to phonemes and undergoes a speech-to-text process to be compared with the previously established verbal phrase. If, at 1052 the uttered phrase matches the previously established verbal phrase, the container is unlocked at 1054. An alert is issued at 1058. The alert can include one of an authorized access, unauthorized access attempt, or other delivery-related event. The alert may be transmitted to the remote computing device 426, and/or storage container access server 402.

As an example of such a use case, consider an end user that wishes to give a neighbor one-time access to his container. The end user sets a passphrase of "Elephant 9-8-7-3 Maple." This passphrase containing unrelated words with a number sequence in between is unlikely to be uttered during the course of natural conversation. Thus, it is highly unlikely that the normal course of nearby conversations could inadvertently unlock the container.

The neighbor, in order to apply the verbal passphrase, may first utter a "wake phrase" such as "hello container" followed by the verbal passphrase. Thus, the neighbor may utter "Hello Container, Elephant, nine, eight, seven, three, Maple." Once the uttered verbal phrase is compared with the previously established passphrase and determined to match, the container is unlocked. In this way, access can be provided to people without needing to depend on any additional hardware beyond the container 100. That is, the person being granted access does not need to have his/her own mobile device. In embodiments, the container further includes a microphone; and wherein the memory further includes instructions, that when executed by the processor, cause the processor to unlock the electronically controlled lock in response to detection of an uttered phrase from the microphone that matches a previously-established verbal passphrase.

Figure 11:
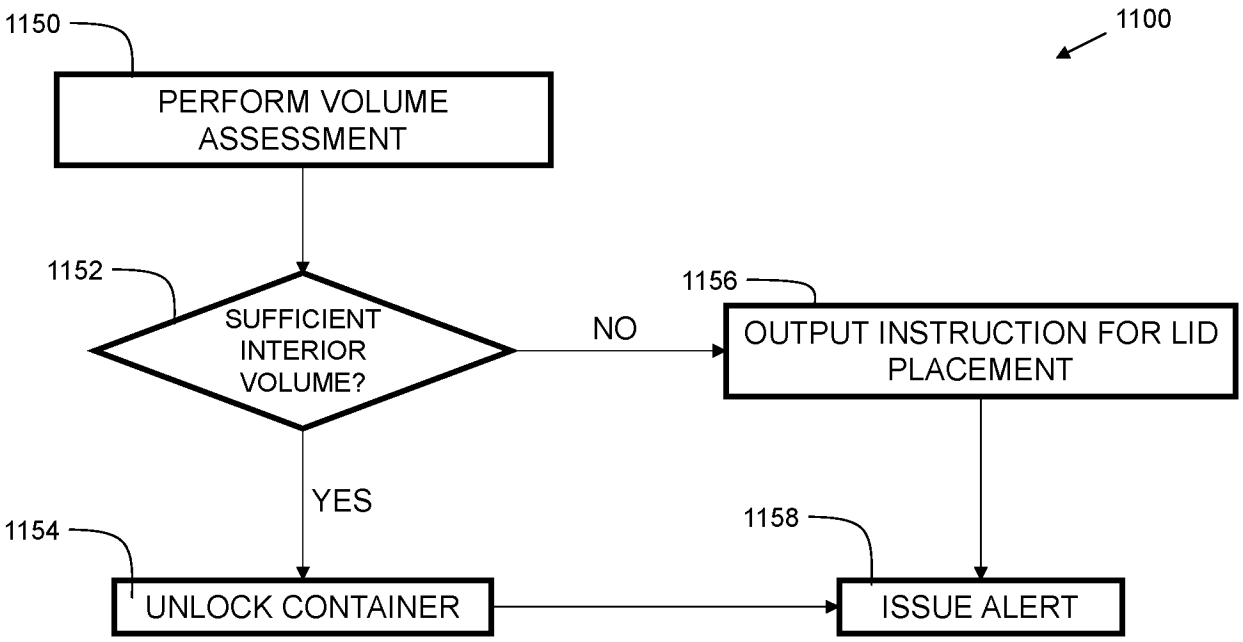
FIG. 11 is a flowchart indicating process steps including a volume assessment, in accordance with embodiments of the present invention.

FIG. 11 is a flowchart 1100 indicating process steps including a volume assessment, in accordance with embodiments of the present invention. The volume assessment may be used in providing guidance to delivery personnel regarding where to place an object (interior or on the lid surface), and/or when to rearrange the location of objects to accommodate protection of high value and/or perishable items. At 1150, a volume assessment is performed, this may be performed utilizing the interior camera 132 and depth sensor 134 are used in some embodiments to evaluate the available space within the interior 111 of the container 100. At 1152, a check is made to determine if there is sufficient interior volume to accept another object. If yes, then at 1154, the container is unlocked. If at 1152, it is determined there is insufficient interior volume, then an instruction is output for lid placement at 1156. An example of this scenario is illustrated in FIG. 6. An alert is issued at 1158. The alert can include one of an authorized access, unauthorized access attempt, relocating of an object from the interior 111 to the top surface 105 of the lid 104 of the container 100, relocating of an object from the top surface 105 of the lid 104 to the interior 111 of the container 100, placement of an object on the top surface 105 of the lid 104 of the container 100, or other delivery-related event. The alert may be transmitted to the remote computing device 426, and/or storage container access server 402.

Figure 12:
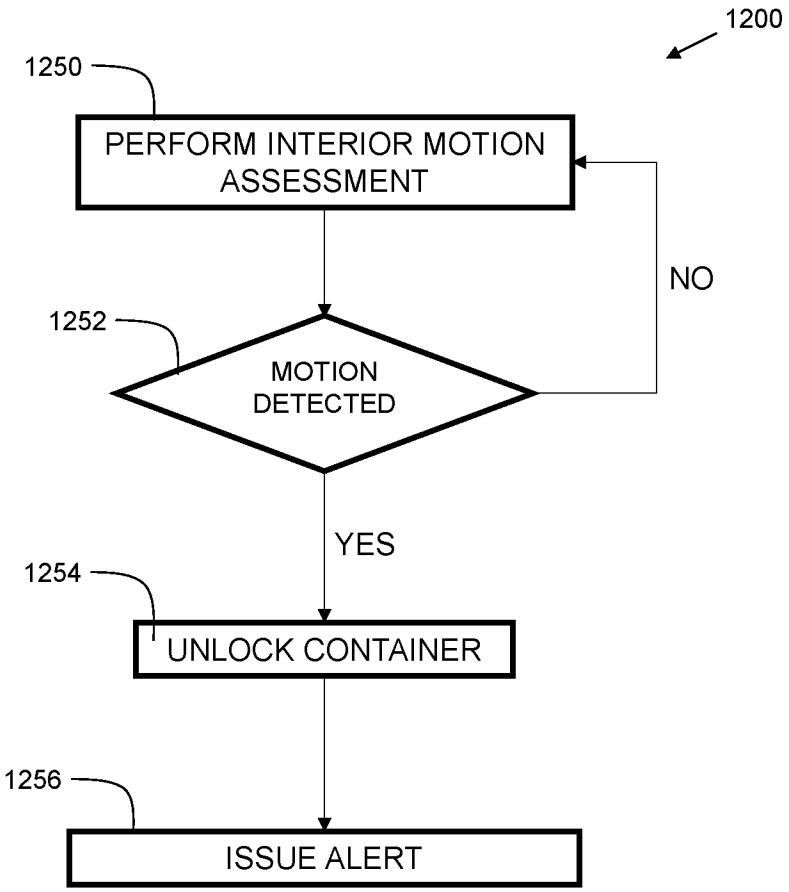
FIG. 12 is a flowchart indicating process steps including an interior motion assessment, in accordance with embodiments of the present invention.

FIG. 12 is a flowchart 1200 indicating process steps including an interior motion assessment, in accordance with embodiments of the present invention. At 1250, an interior motion assessment is performed. Periodically, at 1252, a check is made to determine if motion is detected within the interior 111 of the container 100. If at 1252, motion is detected, then the container is unlocked at 1254, and an alert is issued at 1256. The alert can include an indication that the container became unlocked due to detection of interior motion. The alert may be transmitted to the remote computing device 426, and/or storage container access server 402.

In embodiments, the memory further includes instructions, that when executed by the processor, cause the processor to unlock the electronically controlled lock in response to detection of motion from the interior motion detector. In embodiments, the memory further includes instructions, that when executed by the processor, cause the processor to send an alert to a remote computing device via the communication interface in response to detection of motion from the interior motion detector. These embodiments provide an additional safety measure by preventing someone from being accidentally or intentionally locked in the container.

Figure 13B:
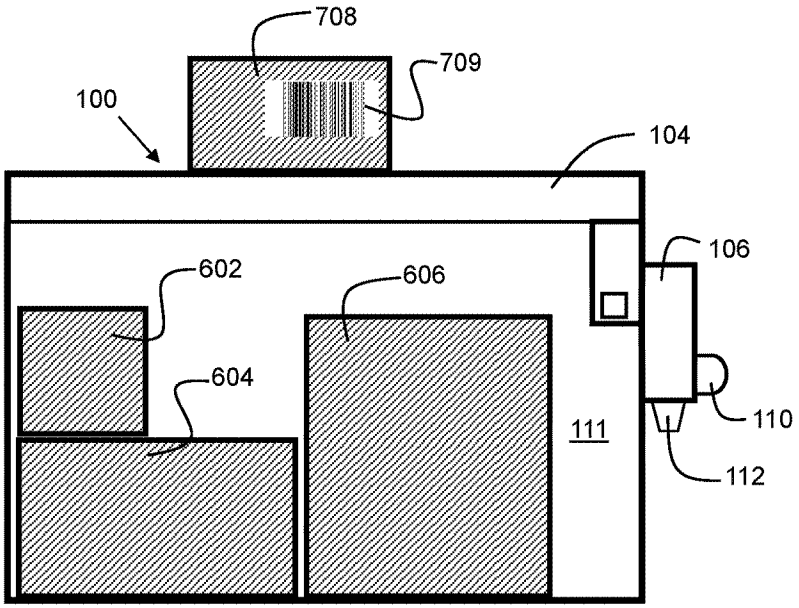
FIG. 13B shows an example of a container with a package disposed on the lid.
Figure 13A:
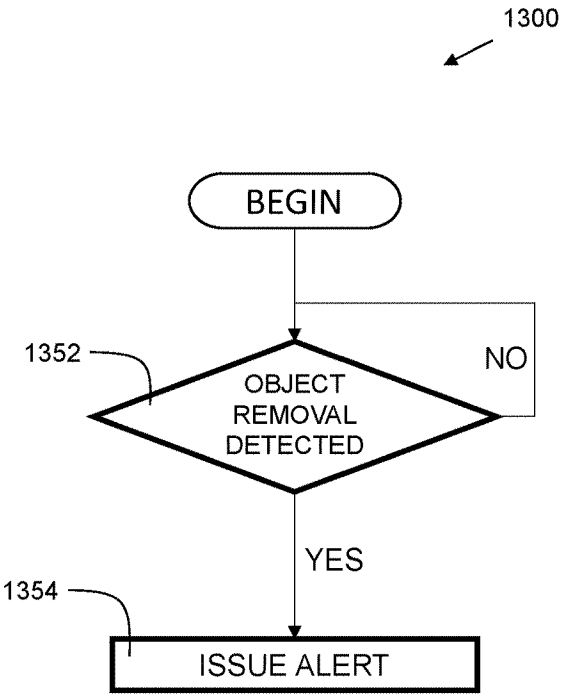
FIG. 13A is a flowchart indicating process steps including a lid object removal assessment, in accordance with embodiments of the present invention.

FIG. 13A is a flowchart 1300 indicating process steps including a lid object removal assessment, in accordance with embodiments of the present invention. In some use cases, an object may be placed on the lid of the container, as shown in FIG. 13B. FIG. 13B shows an object (package 708) disposed on the lid 104 of container 100. Referring again to FIG. 13A, at 1352, a check is made to determine if an object has been removed from the top of lid 104. If yes, then at 1354, an alert is issued. The alert can include an indication that an object/package was removed from the top of the lid 104. In embodiments, this may occur based on signals generated from the lid object sensor 124 (FIG. 1). The alert may be transmitted to the remote computing device 426, and/or storage container access server 402. As an example, if a user removes package 708 from the lid 104, an alert may then be generated. In some embodiments, the user may be instructed to scan barcode 709 with scanner 112 to confirm which object/package was removed from the lid 104.

Figure 14:
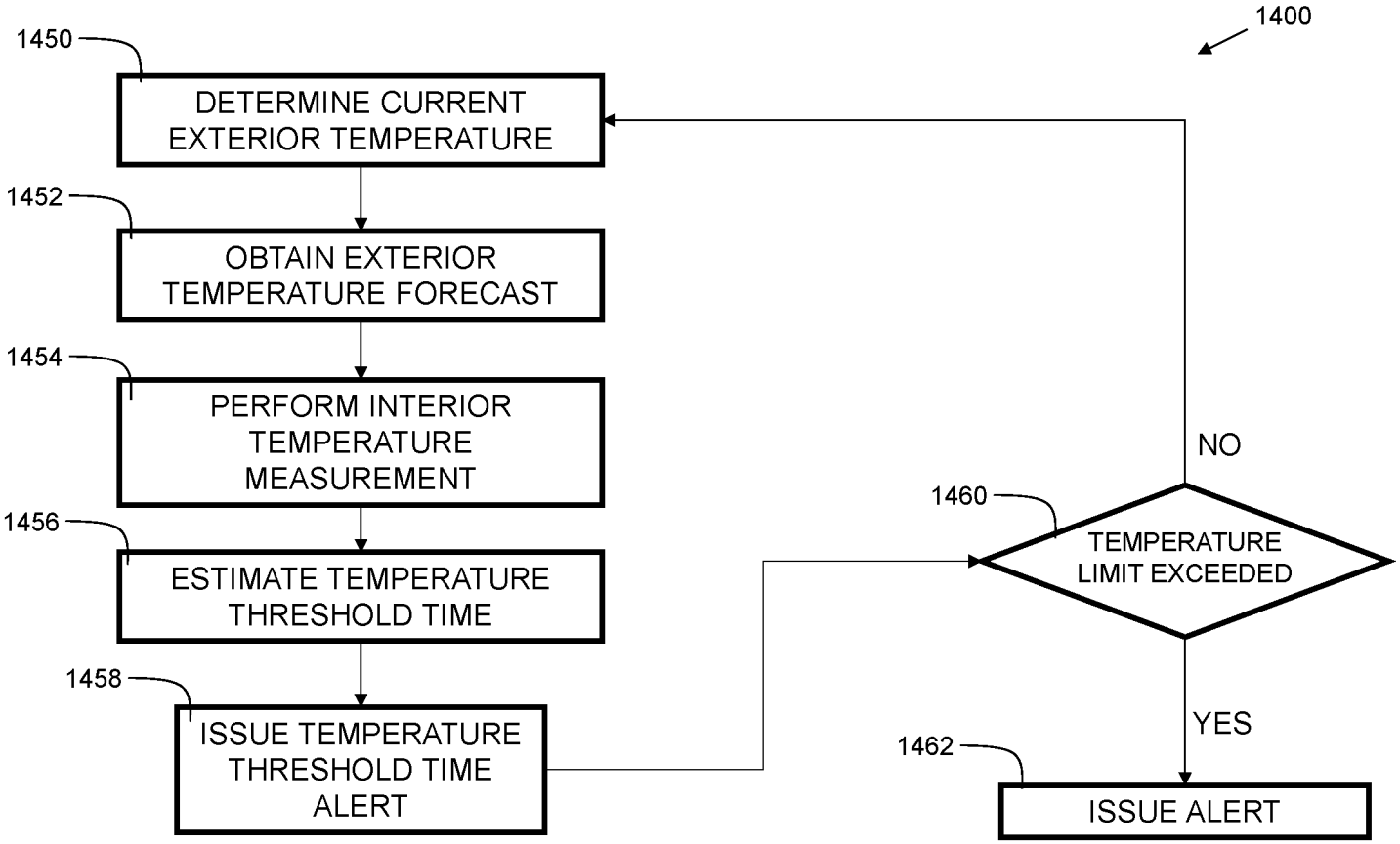
FIG. 14 is a flowchart indicating process steps including an interior temperature assessment, in accordance with embodiments of the present invention.

FIG. 14 is a flowchart 1400 indicating process steps including an interior temperature assessment, in accordance with embodiments of the present invention. At 1450, a current exterior temperature is recorded. This may be performed utilizing data from ambient condition sensor array 530. At 1452, an exterior temperature forecast is obtained. This may be obtained from the 402, which may in turn obtain such data from a weather forecast server such as the National Weather Service (NWS), National Oceanic and Atmospheric Administration (NOAA), or other suitable weather forecasting source. At 1454, an interior temperature measurement is performed. At 1456, an estimated temperature threshold time is determined. In particular, this technique may be used for embodiments without active climate control. For embodiments including containers that are passively cooled with cold packs, dry ice, or other passive cooling device, over time, the interior temperature may increase. The rate at which it decreases depends, at least in part, on the exterior temperature determined at 1450, and the estimated change in exterior temperature as obtained at 1452. From this information, the temperature threshold time can be estimated and/or empirically derived. The temperature threshold time is the time after which, the interior temperature is deemed to be at its limit for keeping the perishable contents properly preserved. A temperature threshold time alert is issued at 1458. The alert can include an indication of when the temperature limit is expected to be reached. The alert may be transmitted to the remote computing device 426, and/or storage container access server 402. At 1460 a check is made to determine if the interior temperature limit is exceeded. If yes, then at 1462, an alert is issued. The alert can include an indication that the interior temperature limit has been exceeded. The alert may be transmitted to the remote computing device 426, and/or storage container access server 402.

As an example, consider a container configured to receive a package containing fresh dairy items, and thus, it is desirable to maintain an interior temperature below 49 F. Cold packs may be placed in the container the morning of the expected delivery, cooling the interior down to 42 F. In the morning, the outside air temperature is 58 degrees. However, by the afternoon, it is forecast that the outside air temperature is expected to reach 94 F. Based on this information, an estimated temperature threshold time can be computed by the electronic communication module 106 and/or storage container access server 402. In such an example, five hours from the present time, the interior temperature is expected to exceed 49 F. Thus, in this scenario, the estimated temperature threshold time is five hours. The following week, a similar situation occurs in the morning. Cold packs may be placed in the container the morning of the expected delivery, cooling the interior down to 42 F. In the morning, the outside air temperature is 58 degrees. However, by the afternoon, due to overcast conditions, it is forecast that the outside air temperature is expected to reach 79 F. In this situation, seven hours from the present time, the interior temperature is expected to exceed 49 F. Thus, in this scenario, the estimated temperature threshold time is seven hours. Thus, disclosed embodiments improve the technical field of unattended secure delivery by determining an estimated duration for which perishable items may be safely stored in the container.

Embodiments include a non-transitory computer memory containing machine instructions, that when executed by the processor, cause the processor to: compute an estimated interior temperature change rate, based on data from the interior temperature sensor and data from the exterior temperature sensor; compute an estimated temperature threshold time based on the estimated interior temperature change rate; and transmit the estimated temperature threshold time to a remote computing device via the communication interface. In embodiments, the memory further includes instructions, that when executed by the processor, cause the processor to: obtain exterior temperature forecast data; and adjust the estimated temperature threshold time based on the exterior temperature forecast data. In embodiments, the memory further includes instructions, that when executed by the processor, cause the processor to transmit the adjusted estimated temperature threshold time to a remote computing device via the communication interface.

Figure 15:
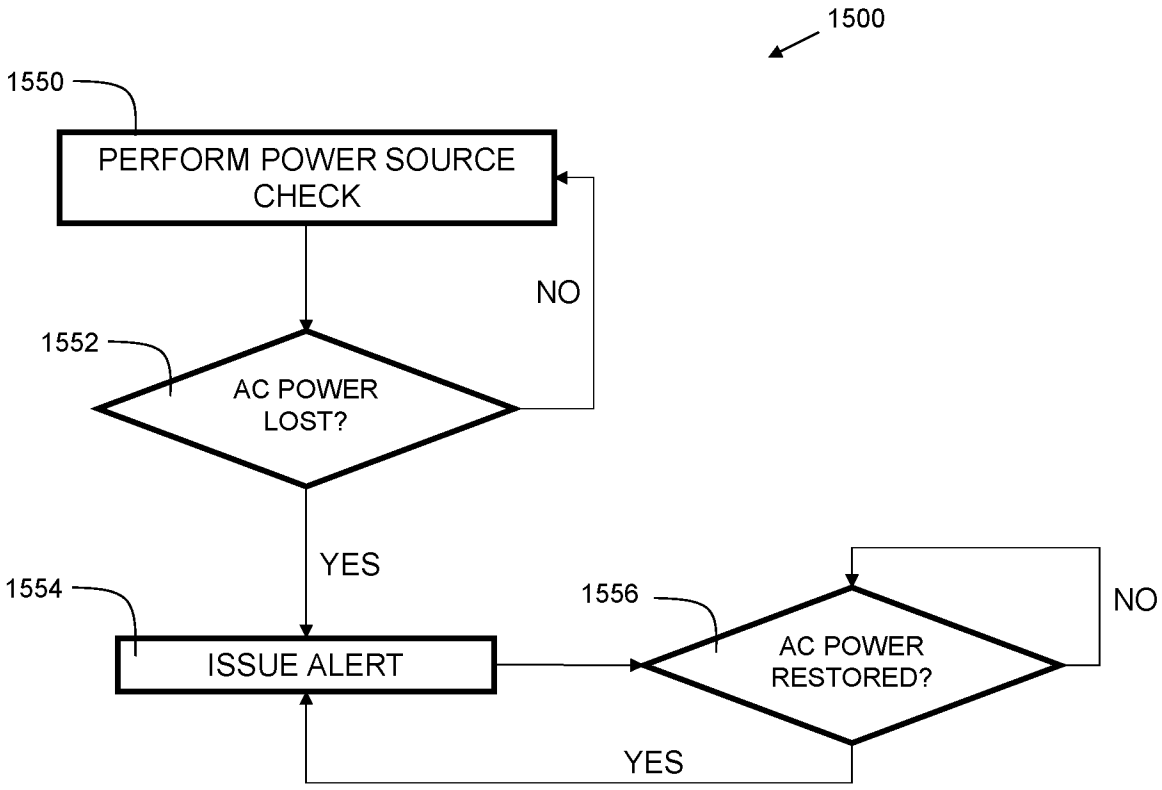
FIG. 15 is a flowchart indicating process steps including a power supply assessment, in accordance with embodiments of the present invention.

FIG. 15 is a flowchart 1500 indicating process steps including a power supply assessment, in accordance with embodiments of the present invention. This pertains to embodiments that utilize power from an AC power source (e.g. household electrical 120V outlet). At 1550, a check is made as to the current source of power (AC or battery). If at 1552, power is lost, then an alert is issued at 1554. The alert may be transmitted to the remote computing device 426, and/or storage container access server 402. The alert can include an indication that AC power was lost (e.g. due to a local power outage). Once power is lost, the process continues to 1556, where the power status is periodically checked to determine if power has been restored. When power is restored, an alert is again issued at 1554. The alert can include an indication that AC power is restored (e.g. after a local power outage has been resolved).

Figure 16:
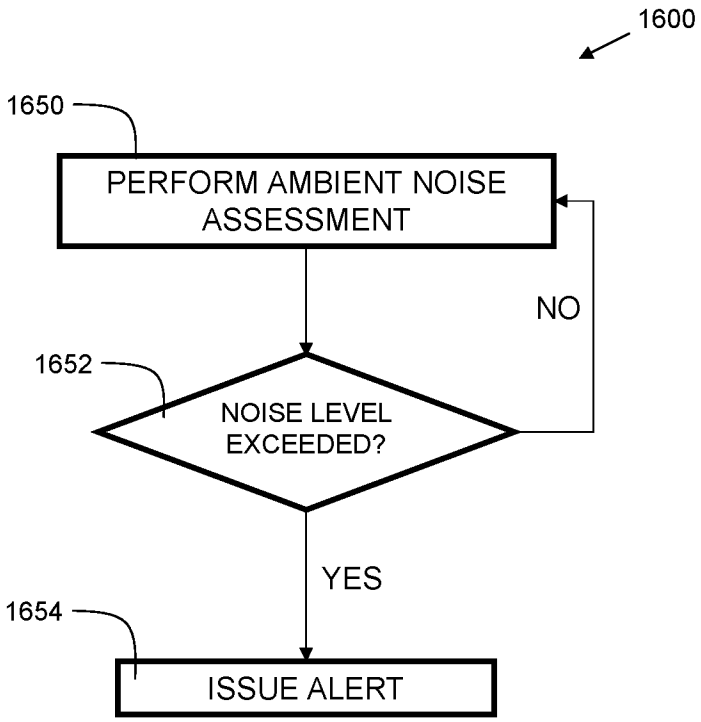
FIG. 16 is a flowchart indicating process steps including an ambient noise assessment, in accordance with embodiments of the present invention.

FIG. 16 is a flowchart 1600 indicating process steps including an ambient noise assessment, in accordance with embodiments of the present invention. This pertains to embodiments that monitor ambient noise to detect tampering attempts. At 1650, a check is made as to the current level of ambient noise. If at 1652, an ambient noise level is exceeded, then an alert is issued at 1654. The alert may be transmitted to the remote computing device 426, and/or storage container access server 402. The alert can include an indication that an ambient noise level is exceeded, as well as an audio and/or video recording from interior and/or exterior cameras and microphone, which the end user may view on a mobile computing device such as a smartphone. Some embodiments may utilize a vibration sensor instead of, or in addition to, the microphone as a mechanism for detecting possible tampering.

In embodiments, the container further comprises a microphone; and the memory further includes instructions, that when executed by the processor, cause the processor to send an alert to a remote computing device via the communication interface in response to detection of a sound exceeding a predetermined decibel threshold from the microphone.

Figure 17:
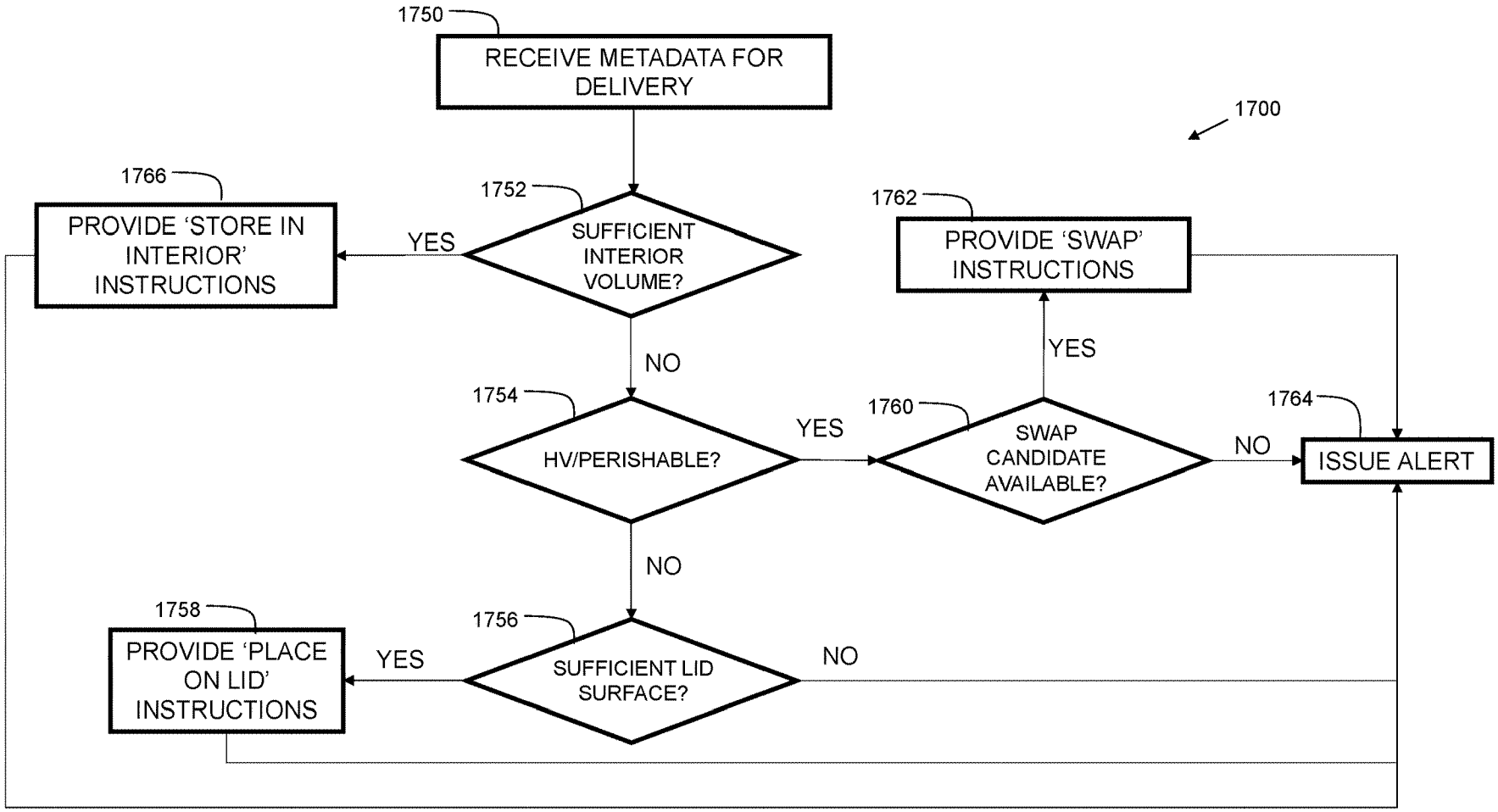
FIG. 17 is a flowchart indicating process steps for issuing delivery instructions in accordance with embodiments of the present invention.

FIG. 17 is a flowchart 1700 indicating process steps for issuing delivery instructions in accordance with embodiments of the present invention. At 1750, metadata for a delivery is received. In embodiments, the metadata may be obtained by scanning a barcode of a package using the scanner 112. The electronic communication module 106 of the container 100 may, based on unique information represented by the barcode, retrieve metadata from a delivery service system server 454 and/or an ecommerce system server 404. In embodiments, the metadata can include dimensions of the delivery. The dimensions can include a length, width, and height for each package within the delivery. Furthermore, additional metadata can include a weight for each package, financial value for each package, and/or a perishable status for each package. The perishable status can be a Boolean field with a true/false value. Additionally, perishable status information may include a preferred temperature range, or additional qualifying status such as refrigerated, frozen, or other status indicating if the package should be kept at a particular temperature range.

At 1752, a check is made to determine if sufficient interior volume is available to accommodate the new package. Since, at 1750, metadata including size dimensions is retrieved, a determination can be made based on current available contiguous volume, which may be evaluated by interior camera 132 and depth sensor 134. If, at 1752, sufficient interior volume is available, then at 1766, instructions are provided to the delivery personnel to store the package in the interior of the container. If at, 1752, it is determined that there is insufficient interior volume available, then the process continues to 1754, where it is determined if the newly arrived package is high value (HV) and/or perishable. In embodiments, a currency value threshold limit may be established by the user (e.g. 100 USD). For packages with a value exceeding the limit, they are deemed to be high value (HV). Similarly, items that should be refrigerated or frozen are deemed as perishable items. In embodiments, HV or perishable items are given priority for interior storage. If at 1754, the newly arrived object/package is deemed not HV or perishable, then the process continues to 1756, where a check is made for sufficient lid surface to place a package. In embodiments, the evaluation for 1756 may be performed via data acquired from the lid object sensor 124. If, at 1756, there is deemed to be sufficient lid surface available for placement of a package, then the process continues to 1758, where instructions are provided to the delivery personnel to store the package on the top surface of the lid of the container.

If, at 1754, it is determined that the newly arrived package is HV and/or perishable, then at 1760 a check is made to determine if a swap candidate is available. A swap candidate may include a previously delivered package that is currently disposed in the interior 111 of the container 100. If the previously delivered package is determined to be not HV and not perishable, based on associated metadata, then that package is a candidate to be removed from the interior, and placed on the lid, making room for the HV/perishable package to be placed in the interior 111 of the container for safe storage.

Disclosed embodiments are configured to recommend an optimal course of action to provide as much security/protection as possible for the delivered objects. As an example, if metadata indicates that the contents of an object are perishable (e.g. fresh dairy products), and that the contents of previously delivered object are non-perishable low value objects, (e.g. a case of paper towels), then the electronic communication module may generate instructions on a mobile device associated with the delivery person, and/or on a screen that is part of the user interface of container 100, indicating that the package of paper towels should be removed from the interior, and the dairy products should be placed in the interior of the container, and then once the lid 104 is closed, the package of paper towels should be placed on the lid of the container. If, at 1760, it is deemed that a swap candidate is available, then at 1762, swap instructions, such as indicated in FIG. 7 at 712, are provided. The process ends at 1764 with issuing an alert. The alert can include one of an instruction to store an object in the interior of the container, an instruction to place an object on the lid, instructions to move an object from the interior to the lid, an alert that the container interior has insufficient space and the lid has insufficient space, and/or other delivery-related event or condition. The alert may be transmitted to the remote computing device 426, and/or storage container access server 402.

Figure 18:
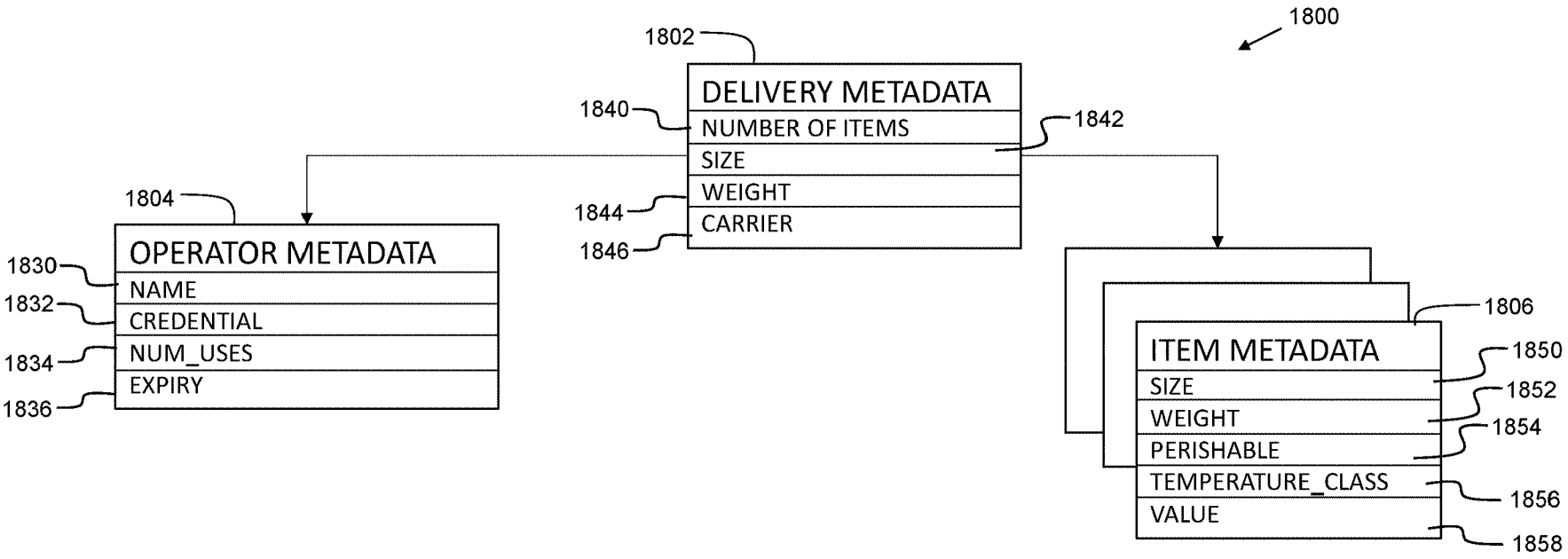
FIG. 18 shows data structures used in embodiments of the present invention.

FIG. 18 shows a diagram 1800 indicating data structures used in embodiments of the present invention. The data structures can include a delivery metadata table 1802. The delivery metadata table 1802 may include a field 1840 for the number of items (objects) included in a delivery, a size field 1842, a weight field 1844, and a carrier field 1846. The delivery metadata table may reference one or more instances of an item data table 1806 (one for each object/package in the delivery). The item metadata table 1806 can include a size field 1850, a weight field 1852, a perishable field 1854, a temperature_class field 1856, and a value field 1858. The operator metadata table 1804 may include information about the person or company delivering the package. The operator metadata table 1804 can include a name field 1830, a credential field 1832, a number_of_uses field 1834, and an expiry field 1836. In embodiments, the tables shown in diagram 1800 may be included in a relational database such as a Structured Query Language (SQL) database. In embodiments, the database is stored on, and/or accessible by, the storage container access server 402.

The size field 1840 and 1850 may further include subfields for length, width, and height of the object. These parameters are collected by many major delivery services when a package is shipped, or as part of the shipping label preparation. The weight field 1844 and 1854 may include weight of the package(s) in pounds and/or kilograms. The temperature_class field 1856 may indicate if the contents of the package are to be kept at a refrigerated or frozen temperature. The value field 1858 includes a currency value for the package, such as US Dollars, Canadian Dollars, Euros, etc.

The name field 1830 indicates the name of the delivery person and/or delivery company. The credential field 1832 may include an encrypted version of a passcode or other authentication code, and/or a hash value of such a code. Field 1834 includes a number of uses for the credential. In some embodiments, a user may specify a one-time use, or limited use credential for someone. In other cases, the number of uses may be unlimited. Field 1836 indicates an expiry date. In some cases, the credential may expire after a certain date, or may have no expiration date set. The carrier field 1846 indicates the carrier (e.g. FedEx, UPS, Amazon, etc.) that is delivering the package. In embodiments, the metadata information shown in FIG. 18 may be retrieved based on supplying a unique identifier, such as a carrier tracking number. In embodiments, the carrier tracking number is encoded on a barcode affixed to the package. Thus, when the package barcode is scanned by the scanner 112 of the container 100, the relevant metadata is retrieved from the delivery service system server 454 and/or an ecommerce system server 404. Other embodiments may have more, fewer, or different tables and database schemas.

Figure 19:
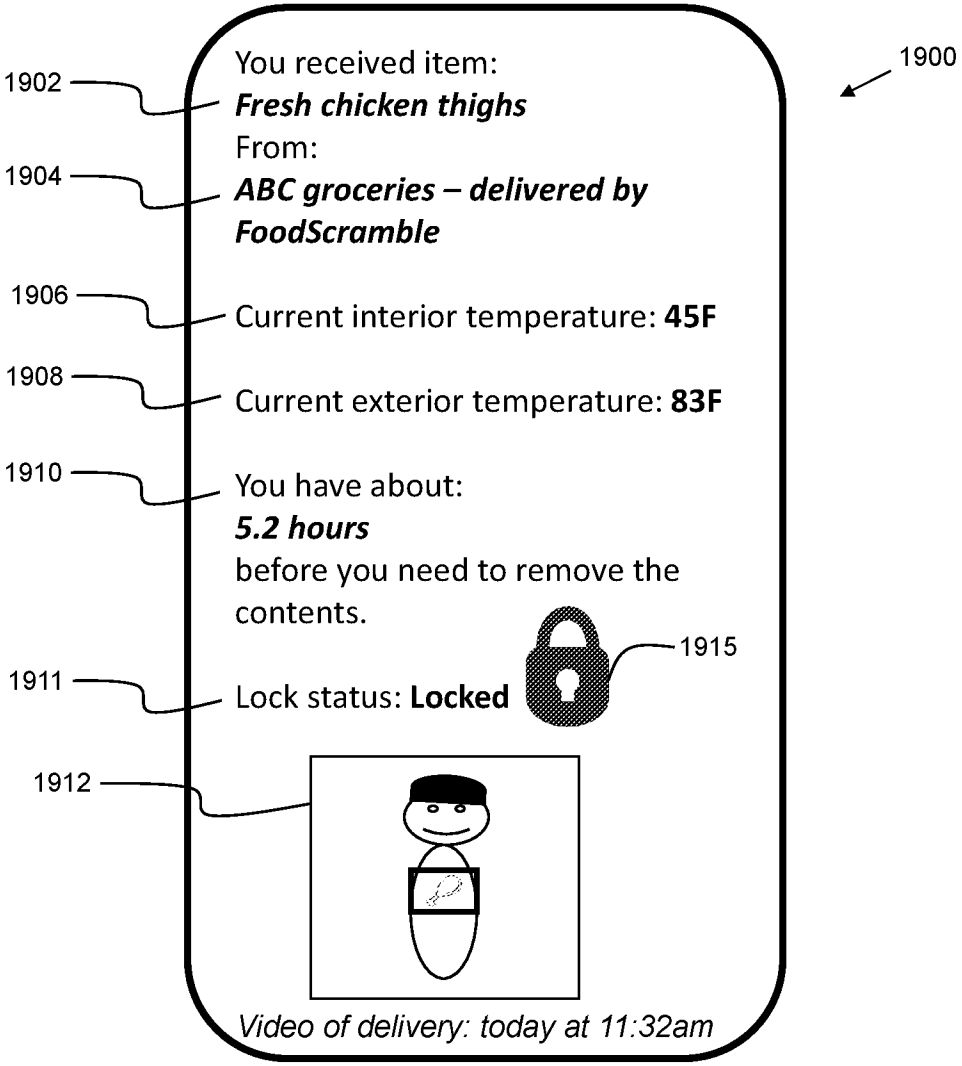
FIG. 19 is an exemplary user interface indicating an estimated temperature threshold time.

FIG. 19 is an exemplary user interface 1900 indicating an estimated temperature threshold time. In embodiments, the user interface 1900 may be rendered by an application (app) executing on a mobile computing device (e.g. smartphone, tablet computer, etc.) associated with a user account. In the example of FIG. 19, field 1902 indicates an item description for a received package. Field 1904 indicates a vendor and/or carrier. Field 1906 indicates a current interior temperature of the container. Field 1908 indicates a current exterior temperature. Field 1910 indicates an estimated temperature threshold time. Field 1911 indicates a lock status. Optionally, an icon 1915 may be used to indicate the lock status in addition to, or instead of, a textual indication of lock status. Field 1912 shows a video clip of the delivery taking place. In embodiments, this video can be viewed live, or on replay after the item was delivered. This user interface is merely an example, and other embodiments may include more, fewer, and/or different fields.

Figure 20:
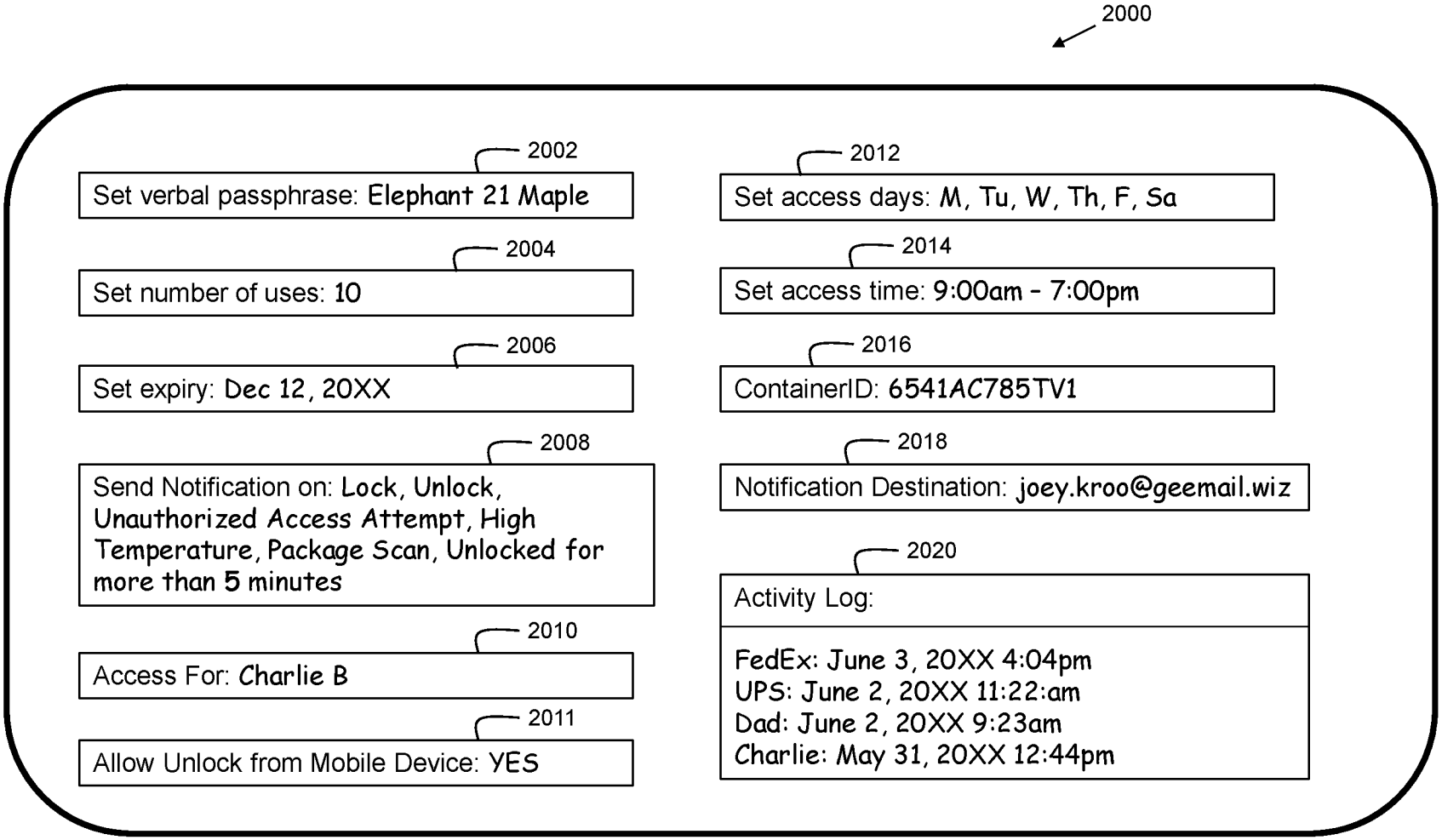
FIG. 20 is an exemplary user interface showing account setup options.

FIG. 20 is an exemplary user interface 2000 showing account setup options. At field 2002, a verbal passphrase can be established. In the example shown, the passphrase is "Elephant twenty-one Maple." When this phrase is uttered into the microphone of the electronic communication module of the container, it causes the container to be unlocked. At field 2004, a number of uses for a credential such as the passphrase can be established. As shown, the passphrase is allowed for ten uses. In practice, the user may enter "1" to create a one-time use access. In embodiments, a value such as "0" or "−1" may be used to signify no limit to the number of accesses. At field 2006, an expiry date can be established. As shown, the expiry date is December 12. As currently configured, the credential expires after ten uses or by December 12, whichever comes first. In some embodiments, the field 2006 can be left blank to signify no expiry date. Thus, embodiments can establish an expiry based on number of uses, a date, or a combination of both number of uses and a specific date.

At field 2008 there is an option for notifications the end user (e.g. container owner) wishes to receive. As shown, there is a notification set for whenever the container is locked, unlocked, an unauthorized access attempt (e.g. a person tries to open the container with an expired or invalid credential), a high temperature warning (see 1460 of FIG. 14), when a package is scanned by the scanner 112, or when the container is left opened/unlocked for more than a predetermined amount of time. The predetermined amount of time may be user-configurable. In the example of FIG. 20, the predetermined amount of time is shown as five minutes. Thus, if someone forgets to close the container, after five minutes, the end user will receive an alert indicating so (e.g. on his/her mobile device via email, text message, and/or app notification).

Field 2010 indicates the person for whom access is being given. Field 2011 is an option to allow unlocking based on a user's mobile device. In such embodiments, the user may install an application (app) on his/her mobile device. The app may transmit a credential (e.g. authorization code) via a wireless protocol such as Wi-Fi or Bluetooth Low Energy (BLE) to allow the container to unlock. Field 2012 indicates specific days that access is allowed for the user specified in field 2010. Field 2014 establishes an allowable access time of day. In embodiments, different users can have different access days and times granted to them. For example, a neighbor can be given only weekend access, while a delivery service can be given only weekday access. Field 2016 indicates a container identifier (ID) for a specific container. The container ID may be a serial number, MAC address, or other suitable unique identifier. In some instances, a user (e.g. homeowner) may have multiple containers. The user can specify which container the options apply to by specifying the container identifier. Field 2018 indicates a notification destination. In embodiments, the notification destination can include an email, phone number, ip address, host name, or other suitable notification destination. Field 2020 shows an example activity log, indicating who unlocked the container and when. In practice, additional events such as failed access attempts may also be included in the activity log. The user interface 2000 is exemplary. Other embodiments may utilize checkboxes, radio buttons, dropdown lists, and/or other user interface elements to allow configuration of container access, reporting, and management options.

As can now be appreciated, disclosed embodiments improve the technical field of unattended package delivery. In the United States alone, 245 million shoppers spend almost 100 hours per year grocery shopping for themselves and their families. Disclosed embodiments, providing a remotely monitored and controlled secure container with climate monitoring and/or control, enable consumers to get some of that time back, by allowing groceries and other packages to be safely and securely stored while they are not home. This enables localized grocery delivery of items such as dairy products, meats, and other items that require cool storage. Additionally, other items, such as non-food packages can be safely stored out of sight from would-be thieves. Furthermore, embodiments can include an intelligent inventory management system that automatically, and without human intervention, prioritizes interior storage based on metadata such as financial value, perishable status, and/or other criteria. Thus, disclosed embodiments can free up additional time, increase convenience, while reducing risk of theft or spoilage of delivered parcels. As a result, consumers may be apt to order more items, knowing that they can be safely delivered, thereby serving to stimulate a new level of economic growth.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, circuits, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

What is claimed is:

1. A lockable storage container, comprising:
a lid;
an electronically controlled lock;
an internal temperature sensor;
an electronic communication module comprising:
a processor;
a communication interface;
a camera system;
an interior motion detector;
a non-transitory computer memory containing machine instructions, that when executed by the processor, cause the processor to transmit a container interior temperature reading and a lock status to a remote computing device via the communication interface;
the camera system including a forward-facing camera, and an interior camera;
the container further including a depth sensor;
the memory further including instructions, that when executed by the processor, cause the processor to compute an occupied volume estimate based on information from the interior camera and depth sensor, and compute a remaining available volume of the container, based on the occupied volume estimate;
the memory further including instructions, that when executed by the processor, cause the processor to issue an instruction for placement of the lid based on the occupied volume estimate, in response to receiving a delivery indication.

2. The container of claim 1, wherein the memory further includes instructions, that when executed by the processor, cause the processor to unlock the electronically controlled lock in response to detection of motion from the interior motion detector.

3. The container of claim 2, wherein the memory further includes instructions, that when executed by the processor, cause the processor to send an alert to a remote computing device via the communication interface in response to detection of motion from the interior motion detector.

4. The container of claim 1, further comprising:
a microphone;

and wherein the memory further includes instructions, that when executed by the processor, cause the processor to unlock the electronically controlled lock in response to detection of an uttered phrase from the microphone.

5. The container of claim 1, further comprising:

a microphone;

and wherein the memory further includes instructions, that when executed by the processor, cause the processor to send an alert to a remote computing device via the communication interface in response to detection of a sound exceeding a predetermined decibel threshold from the microphone.

6. A lockable storage container, comprising:

a lid;

an electronically controlled lock;

an internal temperature sensor;

an electronic communication module comprising:

a processor;

a communication interface;

a barcode scanner;

a camera system;

an interior motion detector;

a lid object sensor;

a non-transitory computer memory containing machine instructions, that when executed by the processor, cause the processor to transmit a lid-disposed object presence status, container interior temperature reading, and a lock status to a remote computing device via the communication interface;

wherein the memory further includes instructions, that when executed by the processor, cause the processor to compute an occupied volume estimate based on information from the interior camera, and compute a remaining available volume of the container, based on the occupied volume estimate;

wherein the memory further includes instructions, that when executed by the processor, cause the processor to:

receive package metadata for a first package based on input from the barcode scanner;

confirm interior storage for the first package based on input from the camera system;

receive package metadata for a second package based on input from the barcode scanner;

determine an insufficient volume condition based on the package metadata for the first package and the occupied volume estimate;

identify a swap candidate based on the package metadata from the first package; and issue a swap instruction to indicate:

removing the first package from interior storage;

placing the second package in interior storage; and placing the first package on the lid.

7. The container of claim 6, wherein the memory further includes instructions, that when executed by the processor, cause the processor to unlock the electronically controlled lock in response to detection of motion from the interior motion detector, and further cause the processor to send an alert to a remote computing device via the communication interface in response to detection of motion from the interior motion detector.

8. The container of claim 6, wherein the camera system includes a forward-facing camera, and an interior camera, and wherein the container further includes a depth sensor configured and disposed to acquire available interior volume information for the container.

9. The container of claim 6, wherein the memory further includes instructions, that when executed by the processor, cause the processor to send an alert to a remote computing device via the communication interface in response to detection of a removed object from the lid object sensor.

10. The container of claim 6, further comprising:

a microphone;

a speaker;

and wherein the memory further includes instructions, that when executed by the processor, cause the processor to:

receive a verbal passphrase via the microphone; and unlock the electronically controlled lock in response to detecting a verbal passphrase that matches an authorization passphrase.

11. The container of claim 6, wherein the memory further includes instructions, that when executed by the processor, cause the processor to issue an instruction for placement of the lid based on the occupied volume estimate, in response to receiving a delivery indication.

12. A lockable storage container, comprising:

a lid;

an electronically controlled lock;

an interior temperature sensor;

an exterior temperature sensor;

an electronic communication module comprising:

a processor;

a communication interface;

a barcode scanner;

a camera system;

an interior motion detector;

a lid object sensor;

a non-transitory computer memory containing machine instructions, that when executed by the processor, cause the processor to:

compute an estimated interior temperature change rate, based on data from the interior temperature sensor and data from the exterior temperature sensor;

compute an estimated temperature threshold time based on the estimated interior temperature change rate; and transmit the estimated temperature threshold time to a remote computing device via the communication interface.

13. The container of claim 12, wherein the memory further includes instructions, that when executed by the processor, cause the processor to:

obtain exterior temperature forecast data; and adjust the estimated temperature threshold time based on the exterior temperature forecast data, thereby computing an adjusted estimated temperature threshold time.

14. The container of claim 13, wherein the memory further includes instructions, that when executed by the processor, cause the processor to transmit the adjusted estimated temperature threshold time to a remote computing device via the communication interface.

* * * * *